US012667177B2

(12) United States Patent
Dancheva et al.

(10) Patent No.: US 12,667,177 B2
(45) Date of Patent: Jun. 30, 2026

(54) COMB

(71) Applicant: Dyson Technology Limited, Malmesbury (GB)

(72) Inventors: Rumyana Rumen Dancheva, Bristol (GB); Robert Mark Brett Coulton, Bristol (GB); Ayrton Lloyd Taylor Peel, Stroud (GB); David Andrew Tibbetts, Bath (GB)

(73) Assignee: DYSON TECHNOLOGY LIMITED, Malmesbury (GB)

( * ) Notice: Subject to any disclaimer, the term of this patent is extended or adjusted under 35 U.S.C. 154(b) by 89 days.

(21) Appl. No.: 18/725,155

(22) PCT Filed: Dec. 13, 2022

(86) PCT No.: PCT/GB2022/053206

§ 371 (c)(1),
(2) Date: Jun. 28, 2024

(87) PCT Pub. No.: WO2023/131772

PCT Pub. Date: Jul. 13, 2023

(65) Prior Publication Data

US 2025/0098834 A1 Mar. 27, 2025

(30) Foreign Application Priority Data

Jan. 7, 2022 (GB) ..... 2200149
Nov. 18, 2022 (GB) ..... 2217289

(51) Int. Cl.
*A45D 20/50* (2006.01)
*A45D 20/12* (2006.01)

(52) U.S. Cl.
CPC ..... *A45D 20/50* (2013.01); *A45D 20/12* (2013.01)

(58) Field of Classification Search
CPC ..... A45D 20/50; A45D 20/12; A45D 20/52; A45D 24/10; A45D 2/44; A45D 24/007
See application file for complete search history.

(56) References Cited

U.S. PATENT DOCUMENTS 1,197,264 A 9/1916 Cobb
1,362,460 A 12/1920 Altwein
(Continued)

FOREIGN PATENT DOCUMENTS

CA 2056204 A1 5/1993
CN 2356547 Y 1/2000
(Continued)

*Primary Examiner* — Khaled Annis
(74) *Attorney, Agent, or Firm* — Tucker Ellis LLP; Michael G. Craig

(57) ABSTRACT

A comb for mounting to a hair-care appliance configured to supply a heated airflow. The comb includes a housing defining an inlet for receiving an airflow from the appliance when mounted thereto and an outlet fluidly connected to the inlet for discharging the airflow. The comb further includes first and second tooth structures mounted to the housing, each tooth structure comprising a row of teeth extending longitudinally across the outlet. The comb also includes a trigger operatively connected to the first or second tooth structure and configured such that depressing the trigger provides relative longitudinal movement between the teeth of the first tooth structure and the teeth of the second tooth structure from a retracted position for receiving a tress of hair between teeth of the first and second tooth structures to an extended position for clamping the tress of hair between teeth of the tooth structures.

19 Claims, 15 Drawing Sheets

(56) References Cited

U.S. PATENT DOCUMENTS

| | | | | |
|---|---|---|---|---|
| 1,642,916 | A | 9/1927 | Anderson | |
| 1,858,851 | A | 5/1932 | Buchanan | |
| 2,227,451 | A | 1/1941 | Huppert | |
| 3,840,030 | A | 10/1974 | Baker | |
| 3,981,313 | A | 9/1976 | Burke et al. | |
| 5,553,632 | A | 9/1996 | Burkhardt | |
| 5,894,849 | A | 4/1999 | Ehlhardt et al. | |
| 6,009,883 | A * | 1/2000 | Morrow | A45D 2/001 132/211 |
| 2004/0250831 | A1 | 12/2004 | Rizzuto | |
| 2004/0261812 | A1* | 12/2004 | Csavas | A45D 2/002 132/271 |
| 2009/0199864 | A1 | 8/2009 | Smal | |
| 2015/0122286 | A1 | 5/2015 | Valle | |
| 2015/0265024 | A1 | 9/2015 | MacLaine | |
| 2017/0042303 | A1 | 2/2017 | Kock | |
| 2017/0273429 | A1* | 9/2017 | Nicolson | A45D 20/48 |
| 2017/0273430 | A1 | 9/2017 | Heffer et al. | |
| 2017/0273431 | A1* | 9/2017 | Courtney | A46B 11/00 |
| 2021/0289909 | A1* | 9/2021 | Kirkbride | A45D 20/12 |
| 2021/0298445 | A1* | 9/2021 | Courtney | A45D 20/50 |
| 2025/0072576 | A1* | 3/2025 | Dancheva | A45D 20/52 |
| 2025/0089873 | A1* | 3/2025 | Beaumont | A45D 20/12 |
| 2025/0098834 | A1* | 3/2025 | Dancheva | A45D 20/50 |
| 2025/0151873 | A1* | 5/2025 | Dancheva | A45D 20/12 |
| 2025/0302175 | A1* | 10/2025 | Ernotte | A45D 20/122 |

FOREIGN PATENT DOCUMENTS

| | | | |
|---|---|---|---|
| CN | 205162251 | U | 4/2016 |
| CN | 207721391 | U | 8/2018 |
| CN | 210747801 | U | 6/2020 |
| CN | 112401438 | A | 2/2021 |
| CN | 212995080 | U | 4/2021 |
| CN | 215423233 | U | 1/2022 |
| DE | 2529809 | A1 | 1/1977 |
| DE | 4236036 | A1 | 4/1994 |
| DE | 20313928 | U1 | 2/2004 |
| EP | 3793399 | B1 | 3/2022 |
| WO | 2010010286 | A2 | 1/2010 |
| WO | 2020109751 | A1 | 6/2020 |

* cited by examiner

COMB

RELATED APPLICATION DATA

This application is a national phase application of International Application No. PCT/GB2022/053206 filed Dec. 13, 2022, which claims priority to GB Application No. 2200149.9 filed Jan. 7, 2022, and GB Application No. 2217289.4 filed Nov. 18, 2022.

TECHNICAL FIELD

The present disclosure relates to combs, including combs of the type that are for mounting to a hair-care appliance configured to supply a heated airflow.

BACKGROUND

Various hair care appliances are known that generate a flow of air for discharge onto a user's hair. One example is a hair dryer or hair styler, which supplies a heated flow of air for styling and/or drying a user's hair. Basic use of a hair dryer for drying a user's hair involves holding the hair dryer at a distance from the user's hair while directing discharged hot air onto the user's hair.

Attachments for hair care appliances (such as hair dryers or hair stylers) are known which provide the appliance with additional functionality. For example, when fitted to a hair care appliance, such attachments may facilitate application of a particular style to a user's hair and/or may increase the suitability of the hair care appliance for use with a particular hair type.

One type of attachment for a hair care appliance (such as a hair dryer) is a comb attachment. Typically, comb attachments include a comb having a row of spaced teeth. In use, a user's hair is received between the teeth of the comb and the comb is moved along the hair to style the hair. In some cases, a comb attachment can be used in this way to smooth and straighten a user's hair (for example to smooth/straighten curly and/or coily hair). Such smoothing and straightening is at least partly provided by the teeth of the comb pulling (i.e. applying tension to) a user's hair as the teeth are moved along the user's hair.

When the attachment is for use with a hair care appliance that generates a heated airflow, typically the teeth of the comb will extend across the discharged airflow so that the airflow passes between the teeth and across hair received therebetween. In this way, the heated airflow can enhance the smoothing/straightening effect applied to the hair.

Such attachments can be somewhat difficult to use. To maximise the styling effect applied to a user's hair, it is desirable to apply tension to the user's hair. Accordingly, a user will typically pull the end of a tress of hair away from their head with one hand, to apply tension to the tress of hair, and with their other hand will hold the hair care appliance (with attachment) and move it along the tensioned tress of hair. The need to use both hands (in a controlled manner) to effectively style the hair increases the difficulty of using such appliances.

Likewise, while such attachments can be effective in straightening and smoothing hair, it can take several passes through a user's hair to achieve a desired result. Further, due to significant variation in hair types across users (for example variation in the curliness or thickness of a user's hair), such attachments may be more effective for some users than others.

As may be appreciated, several of these issues are more generally applicable to all comb types (i.e. including more traditional style combs that are not attached/affixed to a hair care appliance). For example, it is generally desirable to provide a comb (regardless of whether that comb forms part of a hair care appliance) that is effective with a large variety of hair types.

The present disclosure has been devised in light of the above considerations.

SUMMARY

In a first aspect there is provided comb attachment for mounting to a hair-care appliance configured to supply a heated airflow, the comb attachment comprising:

- a housing defining an inlet for receiving an airflow from the appliance when mounted thereto and an outlet fluidly connected to the inlet for discharging the airflow;
- first and second longitudinally extending rows of outer protrusions mounted to the housing so as to extend across or alongside the outlet, each outer protrusion of the first row being transversely spaced from a corresponding outer protrusion of the second row so as to define an outer protrusion pair;
- a longitudinally extending row of inner protrusions mounted to the housing so as to be interposed between the first and second rows of outer protrusions, each inner protrusion moveable longitudinally relative to the outer protrusions between:
  - a retracted position in which the inner protrusion is positioned on a first side of, and is spaced from, a corresponding outer protrusion pair; and
  - an extended position in which the inner protrusion is positioned on a second side of the corresponding outer protrusion pair that is opposite to the first side.

By providing inner protrusions that can pass from one side of an outer protrusion pair to an opposite side of the outer protrusion pair, the comb attachment is able to apply increased tension to a tress of hair passing between the protrusions. For example, a tress of hair can be received in a space between each inner protrusion and the corresponding outer protrusion pair in the retracted position. Each inner protrusion can then be moved (relative to the outer protrusions) to the extended position, which pulls the portion of the tress of hair received in the space (between the inner protrusion and the corresponding outer protrusion pair) through a gap formed between the outer protrusions in the corresponding outer protrusion pair.

As may be appreciated, this action causes the hair to pass along a C- or U-shaped path across the comb. In other words, in the extended position, the hair will pass along a path that extends from one side of an outer protrusion pair, through a gap defined between the outer protrusions, around an inner protrusion (on the opposite side of the outer protrusion pair) and back through the gap between the outer protrusions.

Forcing the hair to pass along this convoluted path increases the resistance to the passage of hair through the protrusions of the comb attachment. In other words, the comb attachment's "grip" on the hair is increased. One consequence of this is that, as a user moves the comb attachment along a tress of hair, greater tension will be applied to the tress (i.e. to the portion of the tress extending between the comb and the user's scalp). In other words, the greater resistance provided by the comb attachment means a user must pull harder to move the comb along the hair, which ultimately translates to greater tension being applied to the hair. This greater application of tension increases the capability of the comb attachment to style a user's hair (e.g. to straighten and/or smooth a user's hair).

Optional features of the first aspect will now be set out. These are applicable singly or in any combination with any aspect.

Each outer protrusion may comprise a proximal end that is proximate to the housing, and an opposite distal end. In some embodiments the distal ends may be free ends. In other embodiments, the distal ends of each outer protrusion of an outer protrusion pair may be joined. In this way each outer protrusion pair may cooperate to define a respective outer tooth having an aperture for passage of an inner protrusion therethrough. Such an arrangement may increase the rigidity of the outer protrusion pair (i.e. outer teeth).

Each outer tooth may have a width in the transverse direction that is greater at the proximal end of the outer tooth than at the distal end of the outer tooth. The width of each outer tooth may taper inwardly from the proximal end to the distal end. That is, the width of each outer tooth may gradually decrease from the proximal end to the distal end. In this respect, each outer tooth may have a substantially triangular shape (i.e. the base of the triangle representing the proximal end and the point of the triangle representing the distal end).

Each aperture defined by a respective outer tooth may have a width in the transverse direction that is greater at a proximal end of the aperture than at a distal end of the aperture. The width of each aperture may taper inwardly from the proximal end to the distal end. In this respect, each aperture defined by a respective outer tooth may have a substantially triangular shape.

Thus, each outer protrusion may be angled inwardly (i.e. towards the other outer protrusion of the respective outer protrusion pair) to form a substantially triangular arch (with a substantially triangular aperture extending therethrough).

Each inner protrusion may have a shape that is complementary to the shape of the aperture formed in each outer tooth. Each aperture defined by a respective outer tooth may have a width in the transverse direction that is greater at a proximal end of the aperture than at a distal end of the aperture. The width of each aperture may taper inwardly from the proximal end to the distal end. In this respect, each aperture defined by a respective outer tooth may have a substantially triangular shape.

The row of inner protrusions may be slideably mounted to the housing. The first and second rows of outer protrusions may be fixedly mounted (or integral with) the housing. In other embodiments, the first and second rows of outer protrusions may be slideably mounted to the housing and the row of inner protrusions may be fixedly mounted.

The comb attachment may comprise a trigger operatively connected to the inner protrusions such that depressing the trigger moves the inner protrusions away from the retracted position and towards the extended position. The operative connection between the trigger and the inner protrusions may be such that there is a direct relationship between the distance moved by the trigger as it is depressed and the longitudinal displacement of the inner protrusions. Thus, a user may be able to control the resistance provided by the comb (and thus the tension applied to a tress of hair) by movement of the trigger (further depression of the trigger resulting in greater resistance being provided by the comb).

The comb attachment may comprise a biasing mechanism configured to bias the inner protrusions towards the retracted position. Thus, depressing the trigger may move the inner protrusions against the force of the biasing mechanism.

In the retracted position, each inner protrusion may be transversely aligned with an outer protrusion pair located adjacent the respective corresponding outer protrusion pair on the first side thereof (i.e. the corresponding outer protrusion pair being the pair that the inner protrusion passes between during movement from the retracted position to the extended position). In other words, each inner protrusion may align transversely between the outer protrusions of an outer protrusion pair in the retracted position (such that the inner protrusion and the outer protrusion pair form a transverse row of protrusions). Accordingly, in the retracted position the attachment may comprise groups of protrusions (each group including an inner protrusion and an outer protrusion pair) that are longitudinally spaced from one another. As may be appreciated, each group of aligned inner/outer protrusions in the retracted position may resemble (and may function as) a single tooth.

Accordingly, in such embodiments, each inner protrusion will travel across the entire space between two pairs of outer protrusions during movement from the retracted position to the extended position. That is each inner protrusion will travel from one pair of outer protrusions to the (adjacent) corresponding pair of outer protrusions (and will subsequently pass between the corresponding pair of outer protrusions). Such an arrangement ensures that all hair received between the inner protrusions (in the retracted position) can then be tensioned by passage of the inner protrusions between and past each corresponding pair of outer protrusions during movement to the extended position.

As may be appreciated, in the alternative (i.e. where the inner protrusions do not transversely align with a pair of outer protrusions in the retracted position), any hair that is behind each inner protrusion (with respect to the direction of movement of the inner protrusion) will not be pulled between the corresponding pair of outer protrusions by the inner protrusion and so will not be tensioned, or will have less tension applied thereto.

In the retracted position, each outer tooth extends about a periphery of an inner protrusion of the row of inner protrusions. That is, in the retracted position, each inner protrusion may be received in the aperture (e.g. closely/snugly received in the aperture) of an outer tooth.

Each inner protrusion and each outer protrusion have a thickness in the longitudinal direction. The thickness of each inner protrusion may be less than or equal to the thickness of each outer protrusion. Accordingly, when transversely aligned (in the retracted position) each inner protrusion may not extend beyond (in the longitudinal direction) the outer protrusions with which the inner protrusion is aligned. For example, longitudinally facing outer surfaces of each inner protrusion (i.e. those surfaces that lead and trail in longitudinal movement of the inner protrusion) may be flush with longitudinally facing outer surfaces of a transversely aligned outer protrusion pair in the retracted position.

In the extended position, each inner protrusion may be disposed equidistantly between the respective corresponding outer protrusion pair and an outer protrusion pair adjacent to the respective corresponding outer protrusion pair, on the second side thereof. In other words, in movement to the extended position, each inner protrusion may pass between and past the respective corresponding outer protrusion pair to a position in which the inner protrusion is approximately halfway towards the subsequent outer protrusion pair (i.e. beyond the respective corresponding outer protrusion pair).

The outer protrusion pairs may be equi-spaced from one another according to a fixed spacing distance. The fixed spacing distance may be defined as the longitudinal distance between the central points of adjacent outer protrusion pairs. In the extended position, each inner protrusion may be displaced longitudinally from the retracted position by a distance that is equal to or greater than the fixed spacing distance. In the extended position each inner protrusion may be displaced longitudinally from the retracted position by at least 1.3 times the fixed spacing distance, or at least 1.5 times the fixed spacing distance, or at least 2 times the fixed spacing distance.

The spacing between the outer protrusions of each outer protrusion pair may be such that a transverse gap having a width of between 0.1 mm and 1.5 mm, or between 0.2 mm and 1 mm, or between 0.2 and 0.7 mm is maintained between each of the outer protrusions and an inner protrusion when passing therebetween.

Each outer protrusion may have an elliptical cross-sectional shape (e.g. an egg-shaped cross-section). Two opposed ends (at either end of the major axis) of the elliptical shape may have different radius of curvatures. Accordingly, an internal edge of each outer protrusion (facing the inner protrusions) may have a larger radius of curvature than an opposing external edge of the outer protrusion. Such an arrangement can reduce or eliminate hair damage by maximising the radius of curvature of any bends formed in hair passing between the protrusions (while maximising space between edges that do not affect the curvature of the hair).

Each outer protrusion may taper inwardly from a proximal end to a distal end (i.e. may have a larger cross-sectional area at the proximal end than the distal end).

Each inner protrusion may have an elliptical cross-sectional shape. The elliptical shape may have a major axis that extends transversely (i.e. parallel to a direction between the outer protrusions of an outer protrusion pair).

When the outlet extends alongside the outer protrusions, the outlet may be arranged to direct airflow in a direction along the outer protrusions (i.e. along the length of the outer protrusions).

Alternatively, the outlet may be arranged to direct airflow across the protrusions (i.e. in the transverse direction). The comb may comprise a curved (e.g. convex) surface adjacent the outlet (e.g. between the outlet and a row of outer protrusions). The curved surface may be arranged so as to direct airflow across the protrusions (transversely). The curved surface may be a Coanda surface (i.e. may be configured to provide airflow attachment by way of the Coanda effect).

Such an arrangement may be particularly beneficial in maintaining control of hair (i.e. reducing dislodgement of hair from the comb in use) when the inner/outer protrusions are in the retracted position. That may occur, for example, at the start and end of a pass along a tress of hair.

In a second aspect there is provided a comb for a hair-care appliance that is configured to supply a heated airflow, the comb comprising:

- a housing defining an inlet for receiving an airflow from the hair care appliance, and first and second longitudinally extending and transversely spaced-apart outlets that are in fluid communication with the inlet;
- a tooth structure mounted to the housing, the tooth structure comprising a row of comb teeth spaced along a longitudinal axis, the row of comb teeth interposed between the first and second longitudinally extending outlets, each tooth extending from a proximal end that is proximate to the housing to a distal free end; and
- a flow director movably mounted to the housing so as to be moveable between a first position in which the flow director directs airflow from the inlet to the first outlet, and a second position in which the flow director directs airflow from the inlet to the second outlet.

When the comb is moved along a user's hair there will be a portion of hair between the user's scalp and the comb that is placed under tension, and a portion beyond the comb that is not under tension. It can be desirable to direct air onto the tensioned portion of the hair (to maintain the hair in the tensioned (straightened) state). Providing two outlets, with one arranged on each side of the comb teeth, ensures that air can be discharged onto the tensioned portion of the hair regardless of the direction of movement of the comb along a tress of hair. Further, providing a flow director that can selectively direct airflow to one of the outlets means that all air received through the inlet can be directed by the flow director to the more desirable outlet of the two in use (e.g. the outlet arranged to discharge air onto the tensioned portion of hair for a given direction of use).

Optional features of the second aspect will now be set out. These are applicable singly or in any combination with any aspect.

The comb may comprise an actuator configured to move the flow director to each said position in response to movement of the comb along a tress of hair in use. The actuator may be configured to move the flow director:

i) to the first position in response to movement of the comb along a tress of hair in a direction in which the second outlet leads the first outlet; and ii) to the second position in response to movement of the comb along a tress of hair in a direction in which the first outlet leads the second outlet.

In some embodiments the actuator may be e.g. an electromechanical actuator. For example, the actuator may actuate in response to a signal from a sensor (such as an accelerometer).

In other embodiments the actuator may be or may comprise the tooth structure. The tooth structure may be moveably mounted to the housing and may be operatively connected to the flow director to move the flow director between the first and second positions.

The tooth structure may be configured to move in a direction that is substantially perpendicular to the longitudinal axis along which the row of teeth extends.

The teeth of the tooth structure may be configured to resist the passage of hair therebetween when the comb is moved along a tress of hair. Said resistance may be effective to pull and thereby move the tooth structure in the direction of movement of the hair between the teeth of the tooth structure. Accordingly, movement of the comb along a tress of hair may be sufficient to cause movement of the tooth structure to said first or second position.

The operative connection between the tooth structure and the flow director may be such that:

- movement of the row of teeth towards the first outlet causes movement of the flow director to the first position; and/or
- movement of the row of teeth towards the second outlet causes movement of the flow director to the second position.

In other words, movement of the row of teeth towards a particular outlet may cause the flow director to direct airflow to that outlet. This may ensure that airflow is directed to the outlet adjacent to (or directing flow at) the tensioned portion of hair.

The tooth structure may be pivotably mounted to the housing, so as to be pivotable about a first pivot axis that extends longitudinally through a proximal end of the tooth structure. The tooth structure may comprise a base portion from which the teeth extend. The first pivot axis may pass longitudinally through the base portion.

The flow director may be pivotably mounted to the housing so as to pivot about a longitudinally extending second pivot axis. The flow director and the tooth structure may engage one another in a region between the first and second pivot axes such that pivotal movement of the tooth structure about the first pivot axis causes pivotal movement of the flow director about the second pivot axis. For example, one of the flow director and tooth structure may comprise a protrusion (e.g. a rib) and the other of the flow director and the tooth structure may comprise a recess (e.g. a groove) for receipt of the protrusion.

The flow director may alternatively be mounted to or integral with the tooth structure. For example, the flow director may be mounted to or integral with a base portion of the tooth structure. In such embodiments, the first pivot axis may be disposed between the row of teeth and the flow director. In this way, movement of the teeth in one lateral direction may cause the flow director to move in substantially the opposite lateral direction.

The flow director may comprise a central body and opposing first and second wings projecting laterally from the central body. The second wing may be arranged to obstruct a flow passage leading to the second outlet when the flow director is in said first position. The first wing may be arranged to obstruct a flow passage leading to the first outlet when the flow director is in said second position.

The comb may comprise a latching arrangement configured to retain the flow director in each of said first and second positions. The latching arrangement may be configured to urge (i.e. bias) the flow director into one of the first and second positions. That is, the latching arrangement may be configured to bias the flow director away from intermediate positions between the first and second positions.

The latching arrangement may comprise a magnet and a ferromagnetic member. The magnet may be provided on one of the flow director and the housing, and the ferromagnetic member may be provided on the other of the flow director and the housing.

The magnet and ferromagnetic member may be a first magnet and a first ferromagnetic member, and the latching arrangement may comprise a second magnet and a second ferromagnetic member. One of the first magnet and first ferromagnetic member may be provided at a tip of the first wing, and the other of the first magnet and the first ferromagnetic member may be provided on the housing so as to be adjacent to the tip of the first wing when the flow director is in the second position. One of the second magnet and second ferromagnetic member may be provided at a tip of the second wing, and the other of the second magnet and the second ferromagnetic member may be provided on the housing so as to be adjacent to the tip of the second wing when the flow director is in the first position.

The latching arrangement may comprise one or more springs (e.g. torsion springs) connecting the flow director to the housing. The one or more springs may be arranged to bias the flow director into the first position when the flow director is closer to the first position than the second position, and into the second position when the flow director is closer to the second position than the first position. The springs may be arranged with the flow director to form an over-centre mechanism.

Each of the first and second outlets may comprise at least one of: a slot and a row of spaced apertures.

One or both of the first and second outlets may be arranged to direct airflow in a direction along the teeth (i.e. along the length of the teeth).

Alternatively, one or both of the first and second outlets may be arranged to direct airflow across the row of teeth (i.e. between the teeth). The comb may comprise one or more curved (e.g. convex) surfaces adjacent one or both outlets. For example, a convex surface may extend from the first outlet to the second outlet. The or each curved surface may be arranged so as to direct airflow across the row of teeth. The or each curved surface may be a Coanda surface (i.e. may be configured to provide airflow attachment by way of the Coanda effect.

Such an arrangement may be particularly beneficial in maintaining control of hair (i.e. reducing dislodgement of hair from the comb in use).

The flow director may be configured to restrict airflow to the second outlet when in the first position, and may be configured to restrict airflow to the first outlet when in the second position. That is, no air (or substantially no air) may flow through the second outlet when the flow director is in the first position, and no air (or substantially nor air) may flow through the first outlet when the flow director is in the second position.

The housing may comprise a mounting portion for detachable mounting to the hair care appliance. In this respect, the comb may form part of a comb attachment for a hair care appliance.

Each tooth of the tooth structure may be a combination of two outer protrusions positioned either side of an inner protrusion. The outer and inner protrusions may be (and may function) as described above with respect to the first aspect (and may take one or more optional features of the first aspect).

In a third aspect there is provided a comb (i.e. comb attachment) for mounting to a hair-care appliance configured to supply a heated airflow, the comb comprising:

- a housing defining an inlet for receiving an airflow from the appliance when mounted thereto and an outlet fluidly connected to the inlet for discharging the airflow;
- first and second tooth structures mounted to the housing, each tooth structure comprising a row of teeth extending longitudinally across the outlet, the first tooth structure being moveable longitudinally relative to the second tooth structure;
- a trigger operatively connected to the first or second tooth structure and configured such that depressing the trigger provides relative longitudinal movement between the teeth of the first tooth structure and the teeth of the second tooth structure from a retracted position for receiving a tress of hair between teeth of the first and second tooth structures to an extended position for clamping the tress of hair between teeth of the tooth structures.

The provision of a trigger that can control relative movement of the tooth structures (and thus the clamping force) allows a user to control the resistance the comb provides as it is moved along a tress of hair. As should be appreciated, greater resistance to movement means that the hair between the comb attachment and the user's scalp is placed under greater tension. Thus, the trigger provides means to control the application of tension to a user's hair when using the comb attachment.

Optional features of the third aspect will now be set out. These are applicable singly or in any combination with any aspect.

The comb may further comprise a biasing member mounted to at least one of the first and second tooth structures. The biasing member may be configured to urge the first and second tooth structures towards the retracted position. This may mean that release of the trigger causes the tooth structures to move so as to release the retracted hair (thereby ensuring that a user can easily release their hair from the comb attachment).

In a fourth aspect there is provided a comb comprising:

a housing;

first and second tooth structures mounted to the housing, each tooth structure comprising a longitudinally extending row of teeth, the first tooth structure being moveable longitudinally relative to the second tooth structure;

a trigger operatively connected to the first or second tooth structures and configured such that depressing the trigger moves the teeth of the first tooth structure longitudinally relative to the teeth of the second tooth structure from a retracted position for receiving a tress of hair between teeth of the first and second tooth structures to an extended position for clamping the tress of hair between teeth of the tooth structures;

a biasing member connected between the first and second tooth structures and configured to urge the first and second tooth structures towards the retracted position.

Providing the biasing member between the first and second tooth structures may allow the biasing member to be concealed within the comb (which may improve durability of the mechanism).

Optional features of the fourth aspect will now be set out. These are applicable singly or in any combination with any aspect.

The housing may comprise a mounting portion for detachable mounting to the hair care appliance. In this respect, the comb may form part of a comb attachment for a hair care appliance.

Optional features of the third and fourth aspects will now be set out. These are applicable singly or in any combination with any aspect.

In the retracted position, each tooth of the first tooth structure may be longitudinally spaced from a corresponding tooth of the second tooth structure so as to define a hair-receiving space therebetween for receipt of a tress of hair.

In the extended position, each tooth of the first tooth structure may be displaced from its retracted position in a direction towards the respective corresponding tooth of the second tooth structure to clamp the tress of hair.

Thus, in use, a user may insert hair between the teeth when in the retracted position and then operate the trigger to move the teeth to the extended position to apply tension to the hair.

In the retracted position, each tooth of the first tooth structure may be transversely aligned with a tooth of the second tooth structure.

The first tooth structure may comprise a first surface that opposes and is longitudinally spaced from a second surface of the second tooth structure. The biasing arrangement may comprise a biasing member extending between the first and second surfaces. The biasing member may be configured to urge the first and second surfaces apart. The biasing member may be a compression spring.

The trigger may be pivotally mounted to the housing so as to pivot about a first pivot axis. The trigger may comprise a lever portion at a first end thereof, and an engagement portion at an opposite second end thereof. The first pivot axis may be interposed between the lever portion and the engagement portion.

In some embodiments, the trigger may be arranged such that, when depressed, the engagement portion engages one of the first and second tooth structures, to move the first or second tooth structure between the retracted and extended positions.

In other embodiments, the comb (or comb attachment) may comprise an intermediate member operatively connected between the trigger and one of the first and second tooth structures. The intermediate member may be pivotally mounted to the housing so as to pivot about a second pivot axis. The intermediate member may comprise an engagement portion that engages one of the first and second tooth structures. The intermediate member may comprise a cam surface (e.g. a concave cam surface) disposed between the second pivot axis and the engagement portion. The engagement portion of the trigger may be arranged to engage the cam surface when depressed to cause the intermediate member to pivot.

The lever portion of the trigger may extend at a first angle to the longitudinal axis in the retracted position, and at a second angle to the longitudinal axis in the extended position, and wherein the second angle is smaller than the first angle. In other words, depressing the trigger may move the lever portion towards the housing.

The trigger may project from the same side of the comb (or comb attachment) as the teeth of the first and second tooth structures. The trigger may project in a plane that is parallel to planes in which the teeth of the first and second tooth structures extend. Such an arrangement may allow a user to depress the trigger with a finger or thumb while holding a hair care appliance to which the comb attachment is mounted (or on which the comb may be mounted or formed).

In some embodiments, the comb or comb attachment may include the outer and inner protrusions as described above with respect to the first aspect. Thus, the teeth of the first tooth structure may represent a first row of outer protrusions, the teeth of the second tooth structure may represent a row of inner protrusions, and the comb may further comprise a second row of outer protrusions (which may form part of the first tooth structure). The row of inner protrusions may be interposed between the first and second rows of outer protrusions, and each outer protrusion of the first row may be transversely spaced from a corresponding outer protrusion of the second row so as to define an outer protrusion pair. The inner protrusions and outer protrusions may be (and may function) as described above with respect to the first aspect (and may take one or more of the optional features of the first aspect).

Likewise, the comb and comb attachment of the third and fourth aspects may comprise the outlets and flow director of the second aspect. In such arrangements, either one of the tooth structures referred to above may be the tooth structure described in the second aspect.

In a fifth aspect there is provided a comb comprising:

a support; and a row of teeth mounted to the support so as to be spaced along a longitudinal axis, each tooth projecting from a proximal end at which it is mounted to the support to a distal free end;

wherein at least one pair of neighbouring teeth at least partly overlap along the longitudinal axis such that the space therebetween defines a transversely extending non-linear path along which hair passing between the pair of teeth extends in use.

Providing at least one non-linear path between neighbouring teeth increases the resistance to the passage of hair between the teeth in the region of the path. Thus, when the comb is moved along a tress of hair, if the hair is passing along the non-linear path, it will be harder to move the comb and, as such, more tension will be applied to the hair. Accordingly, a user can apply tension to their hair when using the comb, by ensuring that at least some of the hair passes along the non-linear path formed between the at least one pair of neighbouring teeth. By doing so, the user may be able to more effectively style (e.g. straighten) their hair.

Optional features of the fifth aspect will now be set out. These are applicable singly or in any combination with any aspect.

The non-linear path may be a first path and the space between the at least one pair of neighbouring teeth may further define a second transversely extending path along which hair passing between the pair of teeth extends in use. The second path may be less tortuous than the first path. In other words, the space between the at least one pair of neighbouring teeth may be such that it includes two regions of different shape, the differences in shape meaning that hair passing through one of the regions must follow a more convoluted (or tortuous) path than hair passing through the other region.

Tortuosity may be determined by:

$$\tau = \frac{C}{L}$$

where C is the length of the respective path and L is the chord length (i.e. the straight-line distance between opposing ends of the path). As should be appreciated, a greater tortuosity may result in higher resistance to the passage of hair therethrough.

The first path may have more bends than the second path. The first path may comprise at least two turns.

The second path may be substantially linear. That is, a tress of hair may be able to travel along the second path in a substantially straight line.

The distance between the first path and the proximal ends of the at least one pair of neighbouring teeth may be less than the distance between the second path and the proximal ends of the at least one pair of neighbouring teeth. In other words, the first path may be closer to the proximal ends of the teeth than the second path.

The tortuosity, taken in a transverse direction, of the space between the at least one pair of neighbouring teeth may decrease gradually in a direction from the first path to the second path. In other words, there may be a gradual change in the resistance provided by the comb in a direction that is parallel to the length of the teeth. For example, the resistance may decrease gradually with distance from the proximal ends of the teeth. That is, hair positioned closer to the proximal ends may experience more resistance than hair positioned further away from the proximal ends. In this way, a user may increase resistance (and thus tension) by ensuring that hair is travelling between the teeth close to their proximal ends, and may reduce resistance by moving the hair away from the proximal ends of the teeth. In other words, the described arrangement may allow a user to control the tension applied to the hair.

The distal ends of the row of teeth may be spaced apart to allow hair to pass between adjacent pairs of teeth. The distance between each adjacent pair of teeth may decrease towards the proximal end of the teeth so provides a varying degree of tension and resistance enabling the user to apply differing amounts of tension and straightening to the hair with a single comb. Thus, the distance between at least one pair of neighbouring teeth decreases towards the proximal end so they at least partly overlap along the longitudinal axis. Thus, different sections of hair can be treated differently for example if there is a knotted area of hair.

Each of the first and second paths may comprise a width defined by the spacing between the at least one pair of neighbouring teeth. The width of the first path may be smaller than the width of the second path. The width may change gradually between the first and second paths. In other words, the spacing between the at least one pair of neighbouring teeth may gradually narrow (e.g. in a direction towards the proximal ends of the teeth). The smaller width of the first path may result in increased resistance to the passage of hair relative to the second path.

The at least one pair of neighbouring teeth may include a first tooth and a second tooth. A portion of the first tooth may be nested within a portion of the second tooth so as to define the non-linear path therebetween.

The first tooth may comprise a protrusion (e.g. a rib or ridge) extending at least partly along the length of the first tooth. The second tooth may comprise a recess (e.g. a groove or trough) extending at least partly along the length of the second tooth. The recess may have a shape that is complementary to the protrusion. The protrusion may be at least partially received in the recess. In this way, the non-linear path may be defined between the protrusion and the recess.

The height of the protrusion from a body of the first tooth may be greater at a proximal end of protrusion than at a distal end of the protrusion. That is, the protrusion may be more pronounced at the proximal end than the distal end. The height of the protrusion may gradually decrease from the proximal end to the distal end.

The depth of the recess into a body of the second tooth may be greater at a proximal end of recess than at a distal end of the recess. That is, the recess may be deeper at the proximal end than the distal end. The depth of the recess may gradually decrease from the proximal end to the distal end.

Each tooth may comprise first and second transversely spaced legs. Each leg may comprise a proximal portion that is proximate the support, and a distal portion that is distal from the support. The distal portions of the first and second legs may be joined. The proximal portion of the first leg may be spaced from the distal portion of the first leg in a first direction along the longitudinal axis. The proximal portion of the second leg may be spaced from the distal portion of the second leg in a second direction along the longitudinal axis that is opposite to the first direction.

The teeth may be arranged such that the proximal portion of the first leg of each tooth is transversely aligned with the proximal portion of the second leg of a neighbouring tooth.

The first and second legs of each tooth may form part of an outer member of the tooth. Each tooth may further comprise an inner member surrounded by the outer member.

The inner member may comprise third and fourth transversely spaced legs disposed between the first and second legs. Each of the third and fourth legs may comprise a proximal portion that is proximate to the support and a distal portion that is distal from the support.

The distal portions of the third and fourth legs may be joined. The proximal portion of the third leg may be spaced from the distal portion of the third leg in the second direction along the longitudinal axis. The proximal portion of the fourth leg may be spaced from the distal portion of the fourth leg in the first direction along the longitudinal axis.

The third leg may be adjacent the first leg and the fourth leg may be adjacent the second leg.

The teeth may be arranged such that the proximal portions of the first and fourth legs of each tooth interdigitate with the proximal portions of the second and third legs of a neighbouring tooth. As may be appreciated, this interdigitation between the legs may define the non-linear path along which hair passes in use.

Each of the inner and outer members may be formed of wire, for example steel wire (e.g. bent into shape).

The non-linear path may be non-symmetrical about the longitudinal axis. The non-linear path may be configured such that it provides greater resistance to hair passing therealong in a first direction than a second direction that is opposite to the first direction. This may increase the versatility of the comb by providing different resistance depending on the direction of movement of the comb.

Each tooth may comprise opposed edges that lead and/or trail movement of the comb along a tress of hair in use. At least one of the edges may be rounded. Both edges may be rounded. This may facilitate passage of hair between the teeth (and may reduce or eliminate damage to the hair in use). At least one of the edges may comprise a groove extending therealong (extending partway or fully along the edge). In operation, airflow (e.g. received from an outlet of a hair care appliance) may pass along the groove. Thus, the presence of the groove may reduce the extent to which the teeth obstruct airflow from an appliance. In some embodiment, each of the opposed edges of each tooth may comprise a groove.

Each tooth may be curved in a direction along its length. Each tooth may comprise a concave edge and/or a convex edge. The convex edge may be a leading edge. The concave edge may be a trailing edge. The provision of a concave leading edge may provide improved control of the tension provided by the comb. Likewise, the concave leading edge may help to retain a tress of hair between the teeth of the comb (e.g. towards the proximal ends of the teeth).

Each tooth may have a width extending transversely to the longitudinal axis. The proximal end of each tooth may be wider than the distal end. Each tooth may taper inwardly (e.g. gradually) from the proximal end to the distal end.

Each tooth may be individually mounted to the support (e.g. base portion). The teeth may be configured to flex independently of one another. This may allow the teeth to better accommodate different head shapes.

The spacing between teeth may be adjustable. That is, the comb may comprise adjustment means for adjusting the spacing between the teeth. For example, in some embodiments the support may be elongated and may comprise a thread (e.g. a thread having a pitch that varies along its length) and each tooth may comprise an engagement member for engaging the thread. In this way, the teeth may be configured such that rotation of the support causes axial movement (along the length of the support bar) of the teeth. Where the thread has a varying pitch, the teeth may remain equi-spaced as they move along the support. In other words, the pitch may be configured such that when the support is rotated, there remains a consistent spacing between the teeth, and that consistent spacing increases or decreases (i.e. expands or contracts) depending on the direction of rotation.

In some embodiments, each pair of neighbouring teeth may be as described above (i.e. references to "at least one pair of neighbouring teeth" may be read as "each pair of neighbouring teeth").

In a sixth aspect there is provided a comb comprising:

a support; and a row of teeth mounted to the support so as to be spaced along a longitudinal axis, each tooth projecting from a proximal end at which it is mounted to the support to a distal free end; and an adjustment mechanism that is moveable to adjust the spacing between the teeth in the row of teeth.

The provision of an adjustment mechanism that allows adjustment of tooth spacing allows a user to alter the resistance to the passage of hair between the teeth. Altering resistance alters the amount of tension that is applied to a tress of hair as the comb is moved along the tress of hair. Thus, altering the resistance allows a user to alter the tension applied to a tress of hair in use. This allows the comb to be used effectively with a greater variety of hair types.

Optional features of the sixth aspect will now be set out. These are applicable singly or in any combination with any aspect. For example, the comb may be as otherwise described above with respect to the fifth aspect.

The adjustment mechanism may be in the form of a thread provided on the support. Each tooth may be configured for engagement with the thread. In this respect, rotation of the support may provide movement of the teeth in an axial direction of the support (i.e. along a length of the support). The thread may vary in pitch along a length of the support (i.e. the pitch of the thread may be greater at one end of the support than the other, and may change gradually between the ends).

In other embodiments, the adjustment mechanism may comprise biasing members positioned between pairs of adjacent teeth. Each biasing member may be configured to urge the adjacent pair of teeth apart. The comb may comprise a clamping arrangement configured to urge the outermost teeth of the row of teeth towards one another (i.e. configured to clamp the row of teeth), against the bias of the biasing members. For example, the clamping arrangement may comprise two opposed clamping members for clamping the outermost teeth. The clamping arrangement may be adjustable to adjust the distance between the clamping members. In this way, adjustment of the clamping members towards one another may decrease the spacing between the teeth and adjustment of the clamping member away from one another may increase the spacing between the teeth.

In another embodiment, the adjustment mechanism may comprise wedge elements provided between pairs of adjacent teeth. The adjustment mechanism may comprise means for moving the wedge elements between the teeth so as to force the teeth apart.

In a seventh aspect there is provided comb attachment for mounting at the outlet of a hair care appliance for supplying air, the comb attachment comprising:

a housing defining an airflow inlet for receiving air from the appliance and an airflow outlet in fluid communication with the inlet for discharging air received from the appliance; and a comb according to the fifth aspect or the sixth aspect, the comb being arranged such that the longitudinal axis along which the teeth are spaced extends across, or adjacent to, the outlet, and wherein the proximal end of each tooth is proximate the outlet and the distal end of each tooth is distal from the outlet.

The attachment allows more convenient styling of a user's hair. As already discussed, the comb is configured in a manner that means tension is applied to a user's hair as the comb is moved through the user's hair. In this way, the attachment allows a user to apply both tension and airflow to their hair with a single hand. That is, a user does not need to use one of their hands to hold a tress of hair to apply tension to the tress of hair, because that function is provided by the comb of the attachment. Accordingly, the attachment of the sixth aspect allows for more convenient styling of a user's hair.

Optional features of the seventh aspect will now be set out. These are applicable singly or in any combination with any aspect.

Each tooth may have a leading edge that leads in movement along a tress of hair in use and a trailing edge that trails in movement along a tress in use. The leading edge of each tooth may be sloped with respect to a direction of the airflow discharged from the outlet.

In some embodiments, the attachment may be permanently mounted to the outlet of the hair care appliance (i.e. may form part of the hair care appliance).

The attachment of the seventh aspect or the comb of the fifth or sixth aspect may be combined with the comb or attachment of the second aspect. In other words, the row of teeth referred to in the second aspect may be as described in the fifth, sixth and/or seventh aspects.

In a seventh aspect there is provided a hair care system comprising a comb or attachment according to any one of the first to sixth aspects, the comb or attachment mounted to or integral with the outlet of a hair care appliance configured to supply a heated airflow. The hair care appliance may be, for example, a hair dryer or hair styler.

BRIEF SUMMARY OF THE FIGURES

Embodiments will now be discussed with reference to the accompanying figures in which.

DETAILED DESCRIPTION

Aspects and embodiments will now be discussed with reference to the accompanying figures. Further aspects and embodiments will be apparent to those skilled in the art.

Figure 1B:
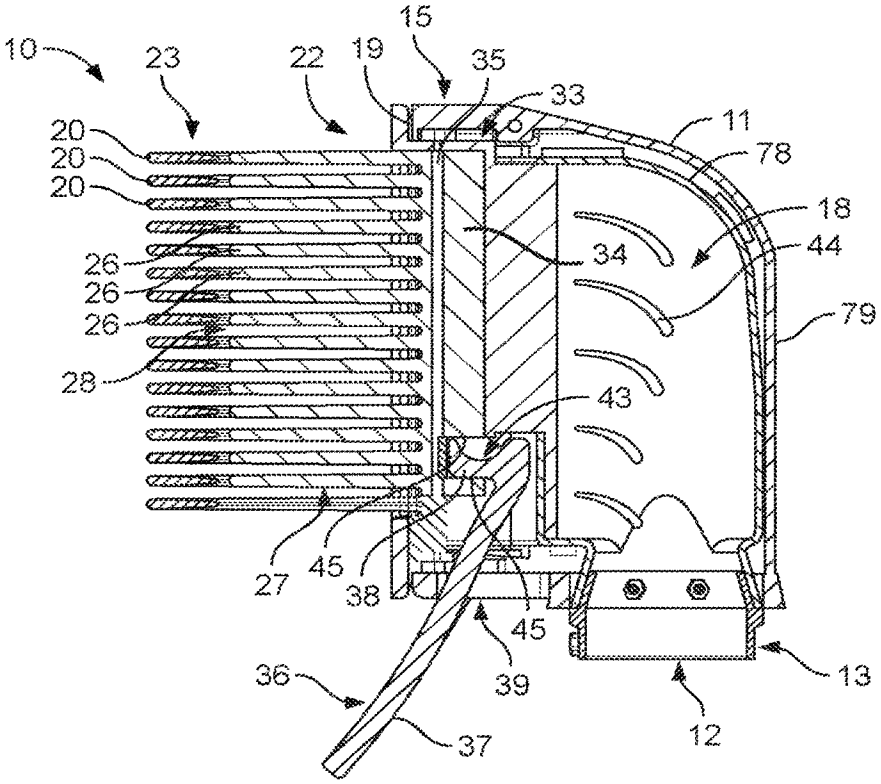
FIGS. 1A and 1B are respective perspective and side views of a first comb attachment in a retracted position.
Figure 1A:
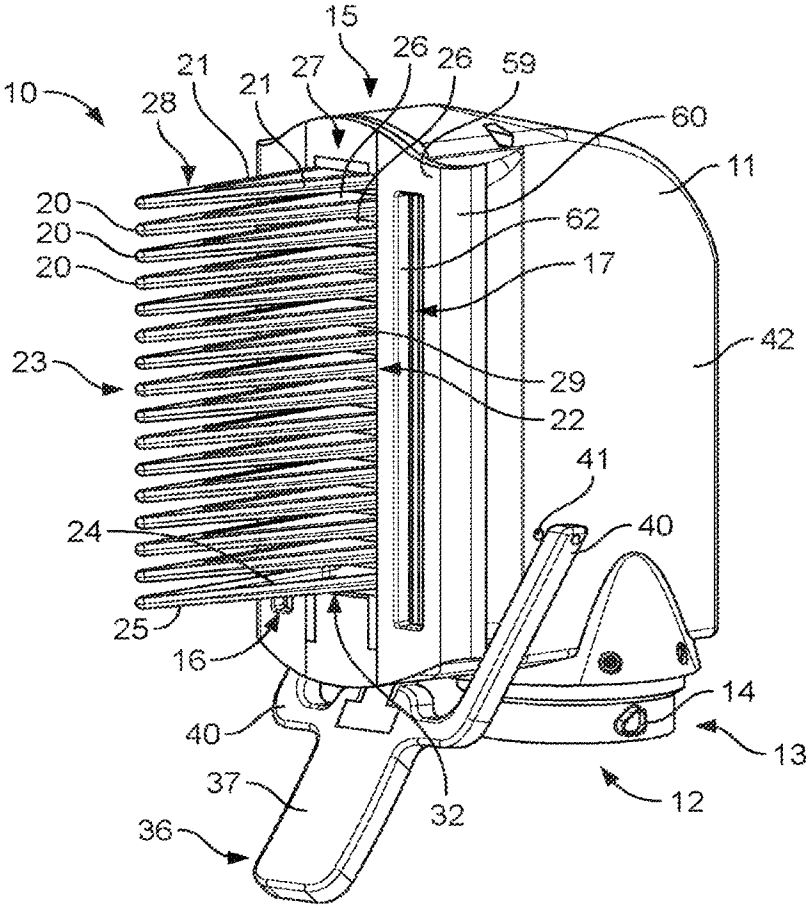
Figure 2B:
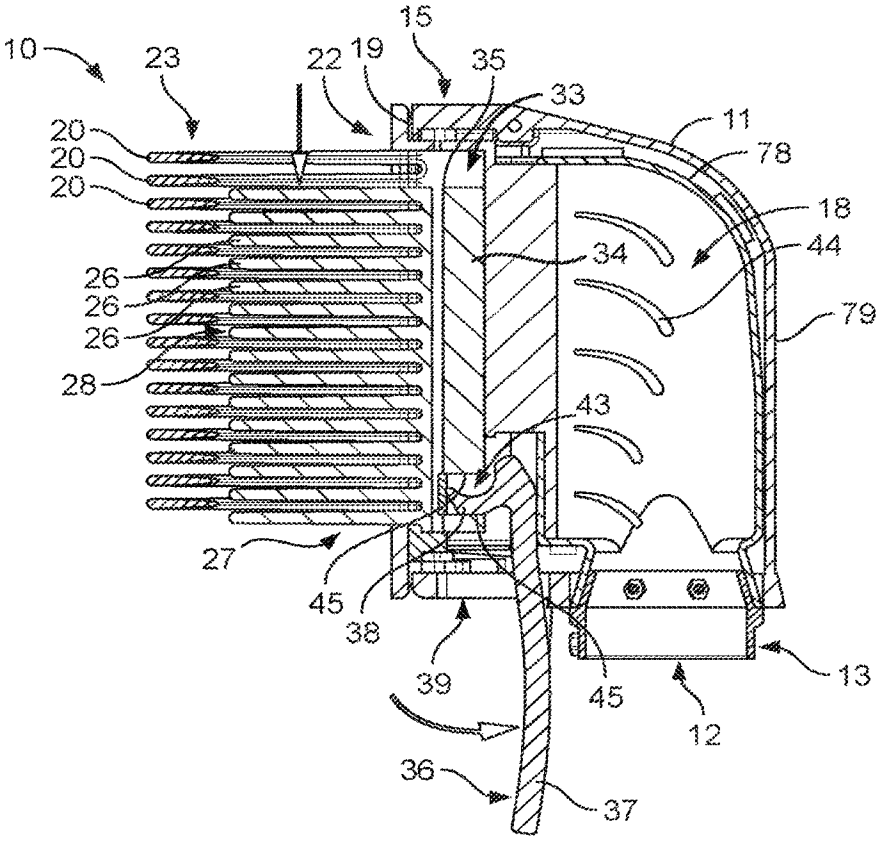
FIGS. 2A and 2B are respective perspective and side section views of the first comb attachment in an extended position.
Figure 2A:
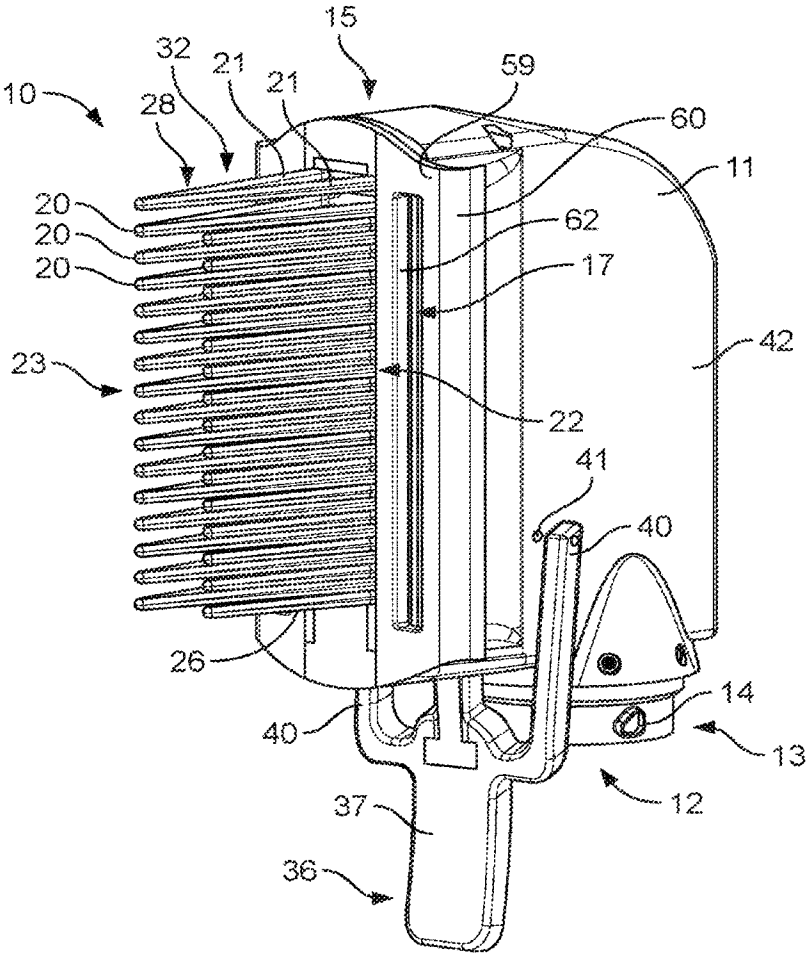

FIGS. 1A and 1B illustrate a comb attachment 10, in a retracted position. FIGS. 2A and 2B illustrate the same comb attachment 10 in an extended position. The comb attachment 10 is for mounting to a hair care appliance, which in the illustrated arrangement is a hair styler (not shown). In particular, the comb attachment 10 is configured for use with a hair styler of the type that includes an elongate cylindrical body (that is held by a user in use) which extends along a linear axis, and an outlet at one end of the body for discharging air in a direction that is coaxial with the linear extension of the body.

The comb attachment 10 comprises a housing 11 defining a circular inlet 12 for receiving an airflow from the hair styler when mounted thereto. The housing 11 is formed of inner 78 and outer 79 parts that are fixedly connected to one another. This two-part construction helps to reduce transfer of heat to an external surface of the housing 11 (being an external surface of the outer part 79).

The inlet 12 is disposed at a proximal end of the housing 11, which for the purposes of explanation will be referred to as the lower end 13 (although it should be appreciated that the attachment may be used in any orientation). The lower end 13 is the end of the housing 11 at which the attachment 10 mounts to a hair styler via a mounting portion 14. The housing 11 extends to an upper (distal) end 15 that is opposite to the lower end 13 (so as to be distal from the hair styler when mounted thereto).

The housing 11 also comprises first 16 and second 17 longitudinally extending outlets, in the form of elongate slots, that are transversely spaced apart from one another. The outlets 16, 17 are fluidly connected to the inlet 12 by an airflow passage 18 that turns approximately 90 degrees from the inlet 12 to the outlets 16, 17. Accordingly, the outlets 16, 17 are provided on an in-use hair-facing surface 19 (apparent from FIGS. 4A and 4B, which are described in more detail below) which represents a front surface of the housing 11 and which extends on a plane that is generally perpendicular to the inlet 12. The outlets 16, 17 are oriented on the hair-facing surface 19 so as to extend generally parallel to an axis extending from the lower end 13 of the housing to the upper end 15 of the housing 11 (i.e. the longitudinal direction in which the outlets 16, 17 extend is generally vertical when the attachment 10 is oriented as illustrated).

In operation, airflow received from the hair styler passes into the attachment 10 via the inlet 12, passes along the airflow passage 18, turns 90 degrees (aided by internal vanes 44), and is then discharged through the outlets 16, 17.

Interposed between the first 16 and second 17 outlets, and mounted to the housing 11, is a longitudinally extending row of outer teeth 20. Each outer tooth 20 is formed of a transversely spaced pair of outer protrusions 21 (i.e. such that the attachment includes first and second transversely spaced longitudinally extending rows of outer protrusions 21). The outer protrusions 21 of each tooth 20 (i.e. each outer protrusion pair) extend transversely inwardly towards one another on a slope from respective proximal ends 22 (proximate to the housing 11) to respective distal ends 23. The distal ends 23 of the outer protrusions 21 in each outer protrusion pair are joined such that each outer tooth 20 has a triangular arch-like shape defining a triangular aperture 32 therethrough. Each outer protrusion 21 includes internal edges 24 (facing inwardly towards the other outer protrusion 21 of the outer protrusion pair) and external edges 25 (facing outwardly). Both the internal edges 24 and the external edges 25 are rounded, which helps to minimise (or eliminate) damage caused to hair in use of the comb attachment 10.

Interposed between the first and second rows of outer protrusions is a longitudinally extending row of inner protrusions 26. Each inner protrusion 26 has a triangular shape that is substantially complementary to the shape of the apertures 32 in the outer teeth 20. Thus, each inner protrusion 26 tapers gradually inwardly from a proximal end 27 (proximate to the housing) to a distal end 28 thereof. Like the outer teeth 20, each inner protrusion 26 includes outwardly facing edges 29 (facing the internal edges of the outer teeth) that are rounded.

Figure 3A:
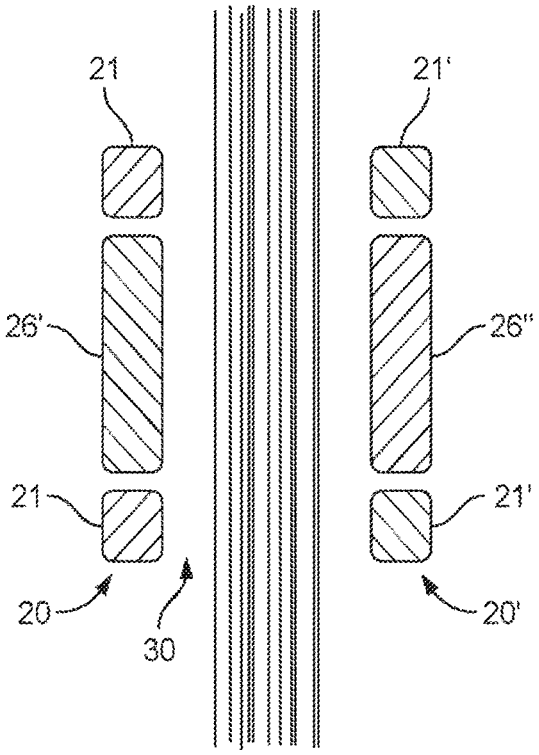
FIGS. 3A and 3B are schematic section views of a portion of the first comb attachment in the retracted and extended positions.
Figure 3B:
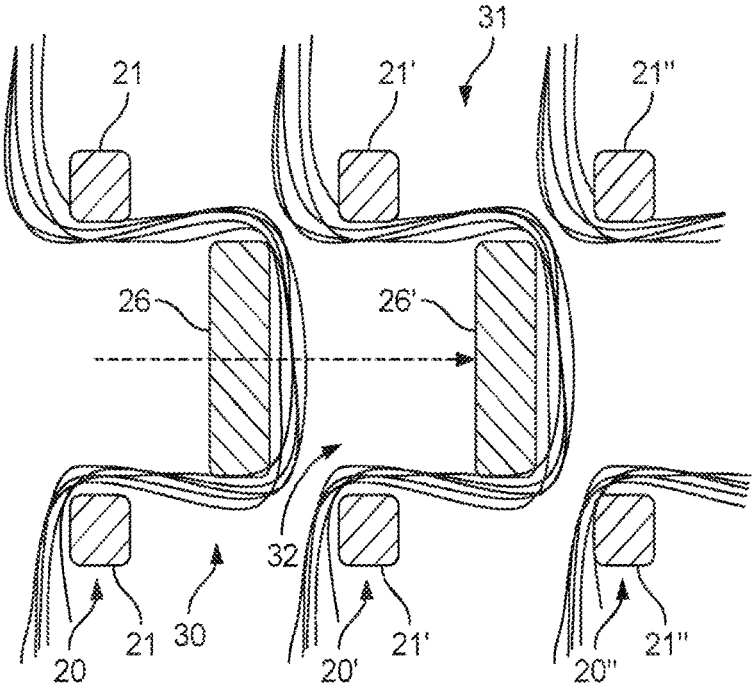

The inner protrusions 26 are slideably mounted to the housing 11 so as to be moveable between the retracted position (as shown in FIGS. 1A and 1B) and the extended position (as shown in FIGS. 2A and 2B). FIGS. 3A and 3B provide a clearer illustration of the movement of the inner protrusions 26. These figures schematically depict a section view of a selection of inner 26, 26', 26" and outer protrusions 21, 21', 21" of the attachment 10 depicted in FIGS. 1A to 2B. As should be appreciated, these could represent any three adjacent inner 26 and outer 21 protrusions of those depicted in FIGS. 1A to 2B. For ease of explanation, the movement of the inner protrusions 26 will be described from the perspective of the leftmost inner protrusion 26' depicted in FIG. 3A. It should, of course, be appreciated that the following description is applicable to any of the inner protrusions 26 forming part of the arrangement depicted in FIGS. 1A to 2B.

FIG. 3A illustrates the inner protrusion 26' in the retracted position. In this position, the inner protrusion 26' is positioned on a first side of, and is spaced from, a corresponding outer protrusion pair 21' that define a corresponding outer tooth 20' (such that a first space is defined therebetween). In particular, the inner protrusion 26' is transversely aligned with an adjacent outer protrusion pair 21 (i.e. defining an adjacent tooth) that are adjacent to the corresponding outer protrusion pair 21'. In this position, each inner protrusion 26', 26" and aligned outer protrusion pair 21, 21' effectively act as a single comb tooth (this also apparent from FIG. 1A). In this way, an entire first space 30 between the corresponding outer tooth 20' and the adjacent outer tooth 20 is open (i.e. free of inner protrusions) for receipt of a tress of hair therein.

FIG. 3B illustrates the inner protrusion 26' in the extended position. In this position, the inner 26' protrusion is disposed on a second side of the corresponding outer tooth 20' (i.e. opposite to the first side). Thus, the inner protrusion 26' has been displaced longitudinally from the retracted position shown in FIG. 3A so as to have moved through and past the corresponding outer tooth 20'. In doing so, the inner protrusion 26' has travelled across the entirety of the first space 30 between the corresponding outer tooth 20' and the adjacent outer tooth 20 on the first side. The inner protrusion 26' has also travelled partway (approximately halfway) across a second space 31 between the corresponding outer tooth 20' and a further adjacent outer tooth 20" (formed by a further outer protrusion pair 21") on the second side of the corresponding outer tooth 20'. In other words, in the extended position, the inner protrusion 26' is displaced longitudinally from the retracted position by a distance that is 1.5 times the spacing distance between adjacent outer teeth 20.

As evident from FIG. 3B, in moving from the retracted position to the extended position, the inner protrusion 26' draws a portion of a tress of hair from the first side of the corresponding outer tooth 20', through the aperture 32 in the corresponding outer tooth 20', to the second side of the corresponding outer tooth 20'. To allow for the passage of both the inner protrusion 26' and the hair through the aperture 32 in the outer tooth 20', the inner protrusion 26' is sized such that a gap extends about the periphery of the inner protrusion 26' when it is positioned in the aperture 32 of the corresponding outer tooth 20'. This gap has a width of about 0.2 mm.

One consequence of the movement to the extended position is that the portion of the tress of hair (that is drawn by the inner protrusion 26') extends along a C-shaped path through the comb attachment 10. As may be appreciated, this tortuous path provides more resistance to movement of the comb attachment 10 along the tress of hair than the linear path that the hair takes in the retracted position (as shown in FIG. 3A). As may also be appreciated, the greater the displacement of the inner protrusion 26' past the corresponding outer tooth 20' (i.e. towards the extended position) the greater the tortuosity of the path along which the hair extends, and thus the greater the resistance to the movement of the comb attachment 10 along the hair. In other words, a user can control the tension applied by the comb attachment 10 by causing the inner protrusion 26' to move towards the extended position (the manner in which this is performed is described further below).

Figure 17:
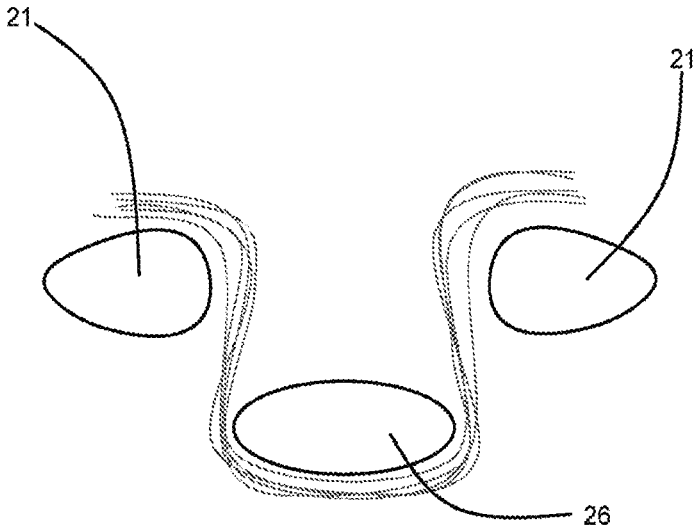
FIG. 17 is a schematic view showing an alternative outlet arrangement to that of FIGS. 4A and 4B.

As may be appreciated, when hair passes along the C-shaped path, the bends around (and is held against) the edges of the inner 26 and outer 21 protrusions. In some circumstances, where the bends formed in the hair are particularly sharp, this could cause damage to the hair. It can therefore be desirable to maximise the radius of curvature of any bends in hair passing between the protrusions 26, 21 (along the C-shaped path). FIG. 17 illustrates an arrangement of inner 26 and outer protrusions 21 that may help to minimise damage by maximising the radius of curvature of any bends in the hair when it extends along the C-shaped path.

In particular, each outer protrusion 21 has an egg-shaped cross-sectional shape. In other words, the cross-sectional shape of each outer protrusion 21 is elliptical with two ends (at either end of the major axis) having different radius of curvatures. In particular an internal edge 24 of each outer protrusion 21 has a larger radius of curvature than an external edge 25 of the outer protrusion. As can be seen from the figure, when hair extends along the C-shaped path, it passes across the internal edges 24 rather than the external edges 25 of each outer protrusion 21. The larger radius of curvature of each internal edge 24 helps to reduce damage to hair passing thereacross. On the other hand, the smaller radius of curvature of each external edge 25 helps to reduce the overall space taken up by each outer protrusion (so as to ensure there is sufficient space for hair to pass between adjacent protrusions 26, 21).

The inner protrusion 26 illustrated in FIG. 17 has an elliptical shape with a major axis that extends transversely (i.e. parallel to a direction between the outer protrusions 21). One consequence of this shape is that the surface across which hair passes has a large radius of curvature, which again helps to minimise damage to the hair.

Although not apparent from the present figure, each outer protrusion 21 may taper inwardly from a proximal end to a distal end (i.e. so has to have a larger cross-sectional area at the proximal end than the distal end). This can also help to maximise space between the protrusions 21 at the distal end and helps to guide hair towards the proximal ends of the protrusions 21 as the attachment is inserted into a tress of hair.

Returning to FIGS. 1A to 2B the inner protrusions 26 are integrally formed as part of a single tooth structure 33. In particular, the inner protrusions 26 extend from a base portion 34 of the tooth structure 33 which extends longitudinally across the airflow passage 18. A pivot rod 35 extends through the base portion 34 to both slideably and pivotally mount the base portion 34 to the housing 11 of the comb attachment 10. To allow a user to slideably move the base portion 34 (and thus the inner protrusions 26) between the retracted and extended positions, the comb attachment 10 further comprises a trigger 36 that is operatively connected to the base portion 34.

The trigger 36 has an elongate lever portion 37 at a first end thereof and an engagement portion 38 at an opposite second end. The lever portion 37 extends through an opening 39 at the lower end 13 of the housing 11. This positioning of the trigger 36 means that, in use (when the attachment 10 is mounted to a hair styler as described above), a user gripping the hair styler with one hand can use a finger or thumb (depending on the manner in which the hair styler is held) to depress the trigger 36.

The trigger 36 is pivotally mounted to the housing 11 by way of two arms 40 that project from opposite lateral sides of the lever portion 37 to two respective pivot points 41 (only one of which is visible) provided on external lateral surfaces 42 of the housing 11 (i.e. disposed either side of the hair-facing surface 19). In this way, the trigger 36 is pivotable towards and away from the housing 11. The provision of external arms 40 (and external pivot points 41) reduces the size of the internal part of the trigger 37 (i.e. the part received in the housing 11) which, for example, allows the size of the airflow passage 18 to be maximised.

The engagement portion 38 of the trigger 36 is disposed within the housing 11 and is in the form of a hook-like protrusion that protrudes from the second end of the trigger 36 in a direction towards the base portion 34 supporting the inner protrusions 26. The engagement portion 38 protrudes into a recess 43 formed in a rearwardly facing side of the base portion 34 (i.e. an opposite side of the base portion 34 to that from which the inner protrusions 26 extend). The recess 43 includes longitudinally spaced, transversely extending walls 45 that the engagement portion 38 engages to move the inner protrusions 26 between the retracted and extended positions.

When the trigger 36 is depressed (pivoting the lever portion 37 towards the housing 11), a lower side of the engagement portion 38 engages one of the transversely extending walls 45 of the base portion 34 to move the inner protrusions 26 to the extended position (in a downward direction as illustrated in FIGS. 1A to 3B). In this way, there is a direct relationship between movement of the trigger 36 and movement of the inner protrusions 26 (and thus the tension applied to a user's hair). Accordingly, the trigger 36 provides means for a user to control the tension applied to the hair being styled.

To return the inner protrusions 26 to the retracted position, the attachment 10 further comprises a biasing member in the form of a compression spring (not shown) that is arranged to urge the base portion 34 into the retracted position (i.e. upwards as illustrated). Thus, upon release of the trigger 36, the biasing member moves the inner protrusions 26 to the retracted position. Likewise, as the base portion 34 moves back to the retracted position it engages the engagement portion 38 of the trigger 36 so as to return the trigger 36 to the undepressed position. One benefit of such an arrangement is that a user can simply release their hair from the comb attachment 10 by releasing the trigger 36.

Figure 4B:
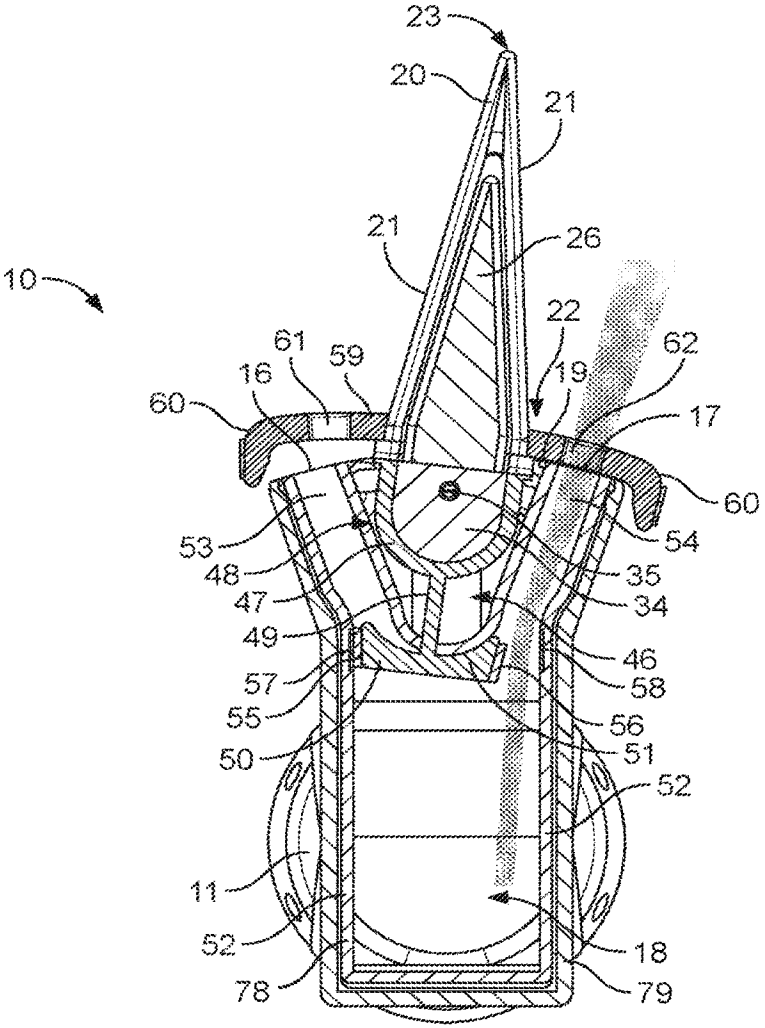
FIGS. 4A and 4B are top section views of the first attachment in first and second positions.
Figure 4A:
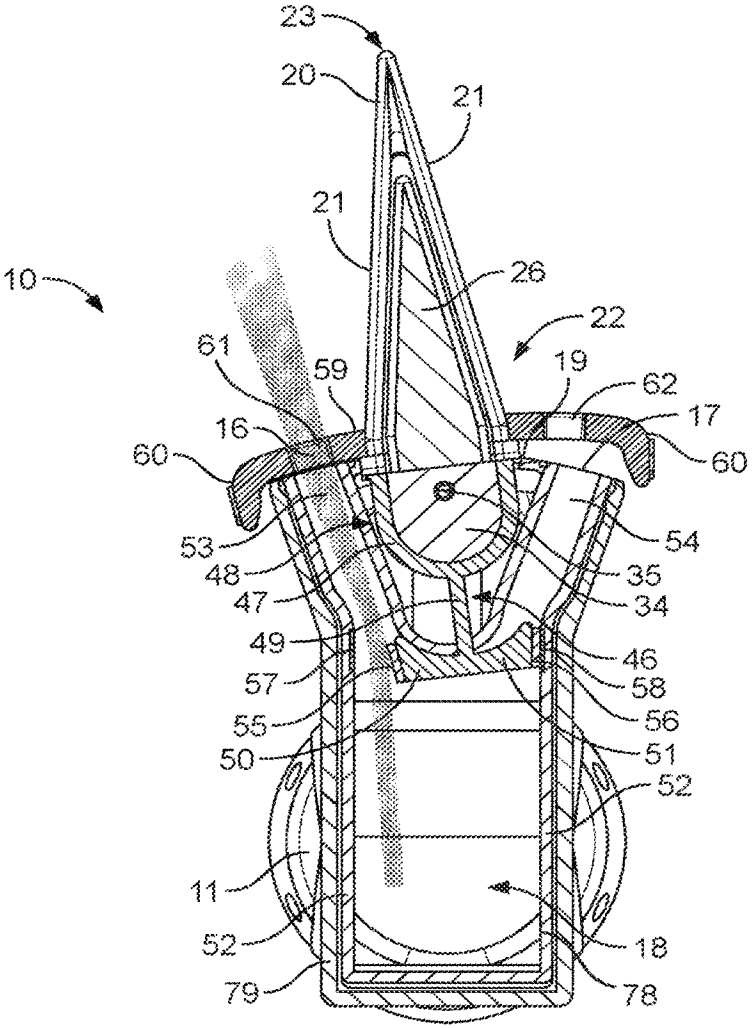

FIGS. 4A and 4B illustrate a further function of the comb attachment 10 described above with respect to FIGS. 1A to 3B. As may be appreciated, in use of the comb attachment 10, a first portion of a tress of a user's hair between the comb attachment 10 and the user's scalp will be placed under tension. A second portion of the tress, on the other side of the comb attachment 10 (between the comb attachment 10 and the distal end of the tress), will not be under tension. It has been found that improved styling can be provided by applying air (preferably heated air) to the portion of a user's hair that is placed under tension by the comb attachment 10.

The provision of outlets 16, 17 positioned either side of the outer teeth 20 of the comb attachment 10 allows such heated air to be discharged onto the tensioned portion of hair in use. In the illustrated embodiment, the outlets 16, 17 direct airflow in a direction along the length of the protrusions 26, 21. In other embodiments, the outlets 16, 17 may be arranged to direct airflow transversely (i.e. across the protrusions 26, 21 and towards one another). Such an embodiment is illustrated schematically in FIG. 17. In this embodiment the outlets 16', 17' face transversely and inwardly towards one another. A curved convex Coanda surface 80 extends between the outlets 16' 17' such that air flowing from the outlets 16'17 attaches to the Coanda surface 80 as it flows thereacross (as will be discussed further below, airflow is discharged from only one of these outlets 16', 17' at a given time). Such an embodiment may be beneficial in regard to controlling the hair received between the protrusions 26, 21 (i.e. may help to prevent dislodgement of hair from between the protrusions 26, 21).

Returning to FIGS. 4A and 4B, the provision of two outlets 16, 17, in particular, allows this to occur regardless of the direction of use of the comb attachment 10 along a tress of hair (i.e. regardless of the direction of use of the comb attachment 10, one of the outlets 16, 17 will direct air onto the tensioned portion of the hair). As will now be described, to further enhance the styling ability of the comb attachment 10, the comb attachment 10 includes means to restrict airflow to only the particular outlet 16, 17 which directs air onto the tensioned hair in a given direction of movement along a tress of hair.

To direct airflow to a particular outlet 16, 17, the attachment comprises a flow director 46 that is movably mounted within the housing 11 so as to be moveable between a first position in which the flow director 46 directs airflow from the inlet 12 to the first outlet 16 (as shown in FIG. 4A), and a second position in which the flow director directs airflow from the inlet 12 to the second outlet 17 (as shown in FIG. 4B). In the illustrated arrangement, the flow director 46 is fixedly mounted to an underside of a U-shaped base portion 47 of a tooth structure 48 that includes the outer teeth 20 (the outer teeth 20 being fixedly mounted to the base portion 47 to form the tooth structure 48).

References herein to a first tooth structure are references to the tooth structure 48 including the outer teeth 20, and references to the second tooth structure are references to the tooth structure 33 that includes the inner protrusions 26. Likewise, references herein to a first base portion are references to the base portion 47 of the first tooth structure 48 and references to a second base portion are references to the base portion 34 of the second tooth structure 33. The second base portion 34 is slideably mounted with the first base portion 47. In particular, the first base portion 47 is trough-shaped so as to define an elongate recess in which the second base portion 34 is received. In other words, the first base portion 47 extends about a lower periphery of the second base portion 34, in the orientation of the comb attachment illustrated.

As discussed above, the base portion 34 is pivotally mounted to the housing 11 by way of a longitudinally extending pivot rod 35 (for pivoting about a pivot axis defined by the pivot rod 35). The fixed mounting of the flow director 46 to the first base portion 47 means that the flow director 46 pivots with the first base portion 47. Likewise, the mounting between the first 47 and second 34 base portions means that they pivot together, such that the flow director 46, first tooth structure 48 and second tooth structure 33 all pivot in unison. Accordingly, when the inner protrusions 26 and outer teeth 20 are caused to move (i.e. pivot), the flow director 46 also moves.

The flow director 46 includes a central body 49 in the form of a flange that projects centrally and rearwardly from the first base portion 47. First 50 and second 51 wings project laterally from an end of the central body 49 (i.e. the end distal from the first base portion 47) towards respective lateral walls 52 of the inner part 78 of the housing 11 that defines the airflow passage 18. The wings 50, 51 are disposed in a portion of the airflow passage 18 that splits into first 53 and second 54 diverging branches that each respectively extend to the first 16 and second 17 outlets.

As can be seen in from FIGS. 4A and 4B, in each of the first and second positions of the flow director 46, one of the wings 50, 51 obstructs a corresponding branch 53, 54 of the airflow passage 18. In the first position (FIG. 4A) the flow director 46 is positioned such that the second wing 51 extends across (so as to obstruct airflow through) the second branch 54. Accordingly, in the first position, substantially all of the airflow entering the inlet 12 of the attachment 10 is discharged from the first outlet 16 via the first branch 53 (with little or no airflow being discharged from the second outlet 17).

In the second position (FIG. 4B), the flow director 46 is positioned such that the first wing 50 extends across the first branch 53 leading to the first outlet 16. Accordingly, in the second position, substantially all of the airflow entering the inlet 12 of the attachment 10 is discharged from the second outlet 17 via the second branch 54 (with little or no airflow being discharged from the first outlet 16).

The flow director 46 can be pivoted (about the pivot axis defined by the pivot rod 35) by movement of the outer teeth 20 and inner protrusions 26. In this way, the outer teeth 20 and inner protrusions 26 act as an actuator for the flow director 46. As the flow director 46 is disposed on an opposite side of the pivot axis to the outer teeth 20 and inner protrusions 26, movement of the outer teeth 20 and inner protrusions 26 in one direction (e.g. to the left as illustrated in FIG. 4A) causes movement of the flow director 46 in the opposite direction (e.g. to the right as illustrated in FIG. 4A). Thus, movement of the outer teeth 20 and inner protrusions 26 towards the first outlet 16 causes movement of the flow director 46 into the first position (so as to obstruct the second outlet 17), and movement of the outer teeth 20 and inner protrusions 26 towards the second outlet 17 causes movement of the flow director 46 to the second position (so as to obstruct the first outlet 16).

In practice, the pivoting movement of the outer teeth 20 and inner protrusions 26 is provided by movement of the comb attachment 10 along a tress of hair. As the comb attachment 10 is moved along the tress of hair, the resistance to passage of hair between the outer teeth 20 and inner protrusions 26 causes the outer teeth 20 and inner protrusions 26 to be pulled by the hair (so as to move the outer teeth 20 and inner protrusions 26 in a direction that is opposite to the direction of movement of the comb attachment 10 along the hair). One result of this is that the outlet 16, 17 that leads in movement along the tress of hair will be closed by the flow director 46 and the outlet 16, 17 that trails in movement along the tress of hair (i.e. the outlet 16, 17 directed at the tensioned hair) will be opened by the flow director 46. Accordingly, substantially all of the airflow received by the comb attachment 10 (i.e. from the hair styler) will be directed onto hair that is in a tensioned state (regardless of the direction of movement of the comb attachment 10 along a tress of hair). As has already been discussed above, this can improve the styling performance of the comb attachment 10 (while maintaining the convenience of bi-directional use of the comb attachment 10).

To retain the flow director 46 in the first and second positions, the comb attachment 10 further comprises a latching arrangement in the form of first 55 and second 56 magnets and first 57 and second 58 respective ferromagnetic members. Each magnet 55, 56 is positioned on the tip of a respective wing 50, 51 of the flow director 46 so as to be adjacent to a portion of a lateral wall 52 of the inner part 78 of the housing 11 in one of the first and second positions. Each ferromagnetic member 57, 58 (in this embodiment, being in the form of a metal plate), is provided in a portion of a lateral wall 52 of the inner part 78 housing 11 so as to be adjacent to a respective one of the magnets 55, 56 in the first or second position. Thus, in the second position a first magnet 55/ferromagnetic member 57 pair are proximate one another (such that there is magnetic attraction therebetween), and in the first position a second magnet 56/ferromagnetic member 58 pair are proximate one another (such there is magnetic attraction therebetween). In this way, the flow director 46 is essentially biased into either the first or second position. That is, the magnets 55, 56 (and ferromagnetic members 57, 58) ensure that the flow director 46 is urged into one of the first and second positions (i.e. is urged away from intermediate positions in between the first and second positions).

In the illustrated arrangement, the comb attachment 10 also comprises a face plate 59 that is integral with the outer teeth 20 (and so pivots with the outer teeth 20). The face plate 59 extends about the proximal ends 22 of the outer teeth 20 so as to extend across (and cover) the hair-facing surface 19 of the comb attachment 10. The face plate 59 includes opposed longitudinally extending (and transversely spaced) edges 60 that are rounded and that extend rearwardly over a (small portion of) the lateral external surfaces 42 of the housing 11. An external surface of the face plate 59, extending between the longitudinal edges 60, has a slightly convex shape. The rounding of the edges 60 and the convex nature of external surface helps to guide hair across the face plate 59 and minimises damage to hair in use.

The face plate 59 includes first 61 and second 62 elongate slots that, depending on whether the flow director 46/outer teeth 20 are in the first or second position, align with the first 16 and second 17 outlets of the comb attachment 10. In particular, the first slot 61 aligns with the first outlet 16 in the first position, and the second slot 62 aligns with the second outlet 17 in the second position.

Figure 5B:
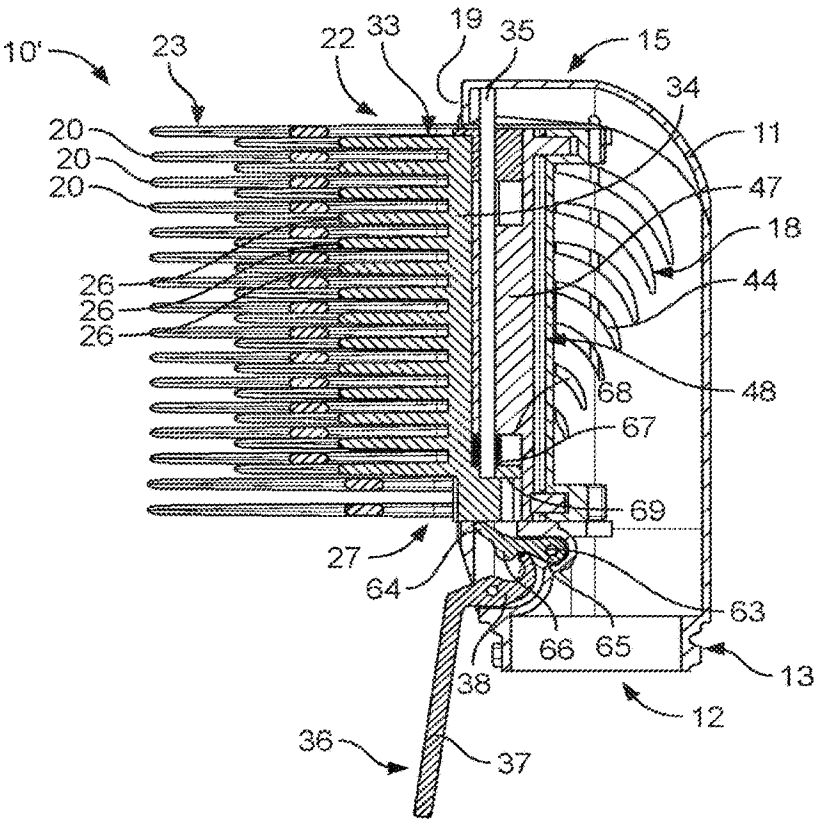
FIGS. 5A and 5B are respective perspective and side section views of a second comb attachment in retracted and extended positions.
Figure 5A:
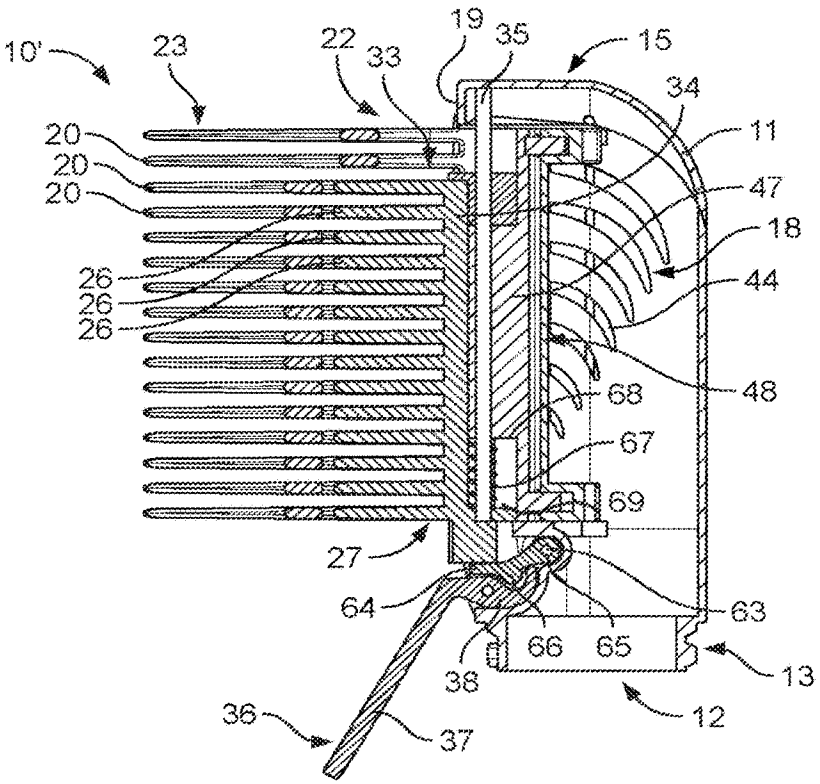

FIGS. 5A and 5B depict a further comb attachment 10' that is a variation of the arrangement described above (and shown in FIGS. 1A to 4B). Many of the features of this arrangement remain the same as that described above and for that reason the same reference numerals have been used for similar features. For brevity, only differences are discussed below.

The predominant difference provided by this comb attachment 10' is in the operative connection of the trigger 36 to the inner protrusions 26. In this arrangement an intermediate member 63 is provided between the trigger 36 and the second base portion 33. Like the trigger 36, the intermediate member 63 is pivotally mounted to the housing 11 so as to be pivotable about a pivot axis. The pivot axis of the trigger 36 is referred to herein as a first pivot axis and the pivot axis of the intermediate member 63 is referred to herein as a second pivot axis.

The intermediate member 63 includes an engagement portion 64 that engages the second base portion 64, and a cam surface 65 that is disposed between the engagement portion 64 and the second pivot axis, and that is partly defined by a bump 66 formed on the intermediate member 63. In this arrangement, the trigger 36 is pivotally mounted to the housing 11 at a point that is internal to the housing 11 and that is intermediate the lever portion 37 and the engagement portion 38 of the trigger 36. Accordingly, movement of the lever portion 36 in one direction causes movement of the engagement portion 38 in the opposite direction.

When the trigger 36 is depressed (so as to pivot about the first pivot axis), the engagement portion 38 of the trigger 36 engages the cam surface 65 of the intermediate member 63 to cause the intermediate member 63 to pivot about the second pivot axis. In turn, the engagement portion 64 of the intermediate member 63 engages an end of the first base portion 34 to move the first base portion 34 longitudinally (upwards as illustrated). This moves the inner protrusions 26 from the retracted position to the extended position.

As may be appreciated, the arrangement of the trigger 36 and intermediate member 63 of this comb attachment 10' allows for a more compact housing 11 than the previously described comb attachment 10. Likewise, the presently described attachment 10' does not require external arms for the purpose of providing a pivoting attachment with the housing 11.

Like the previously described comb attachment 10, the presently described comb attachment 10' includes a biasing member 67 in the form of a compression spring. The biasing member 67 is mounted on the pivot rod 35 and extends longitudinally between the first 47 and second 33 base portions. In particular, the biasing member 67 bears against a first transversely extending surface 68 of the first base portion 47 and a second transversely extending surface 69 of the second base portion 33, which are longitudinally spaced and oppose one another. In this way, the biasing member 67 is arranged to urge the first 47 and second 33 base portions apart. When the trigger 36 is depressed (to move the inner protrusions 26 to the extended position) the second transverse surface 69 is moved towards the first transverse surface 68, which compresses the biasing member 67. On release of the trigger 36, the biasing member 67 expands so as to urge the transverse surfaces 68, 69 apart, which returns the inner protrusions 26 to the retracted position (and the trigger 36 to its resting undepressed state).

A further difference of the second arrangement of the comb attachment 10' (to the first arrangement 10 of FIGS. 1A to 4B) is that it does not include a face plate. Instead, hair passes directly across the hair-facing surface 19. In an even further alternative, the edges of the hair-facing surface 19 are rounded (i.e. radiused) to minimise damage to hair has it passes across the hair-facing surface (i.e. similar to the rounded edges 60 of the face plate 59 of the embodiment shown in FIGS. 4A and 4B).

Figure 6B:
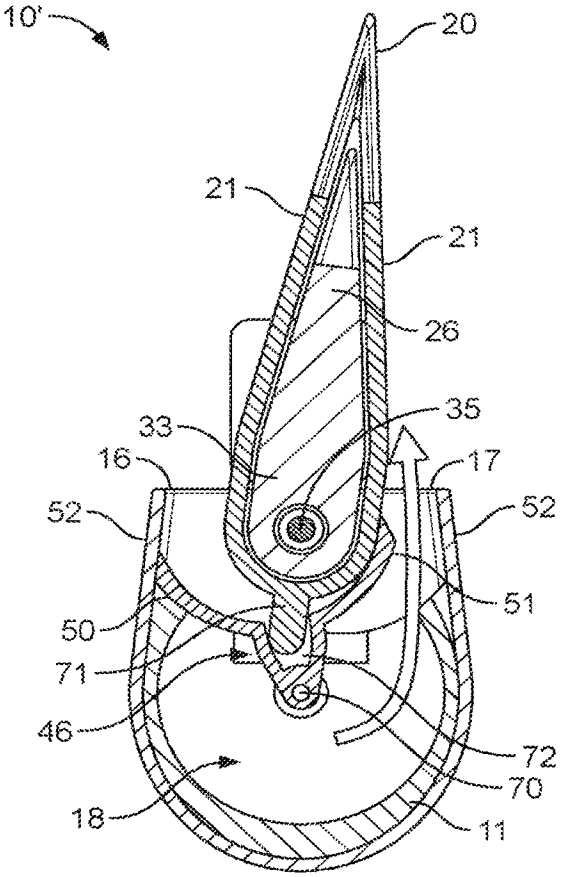
FIGS. 6A and 6B are top section views of the second comb attachment in first and second positions.
Figure 6A:
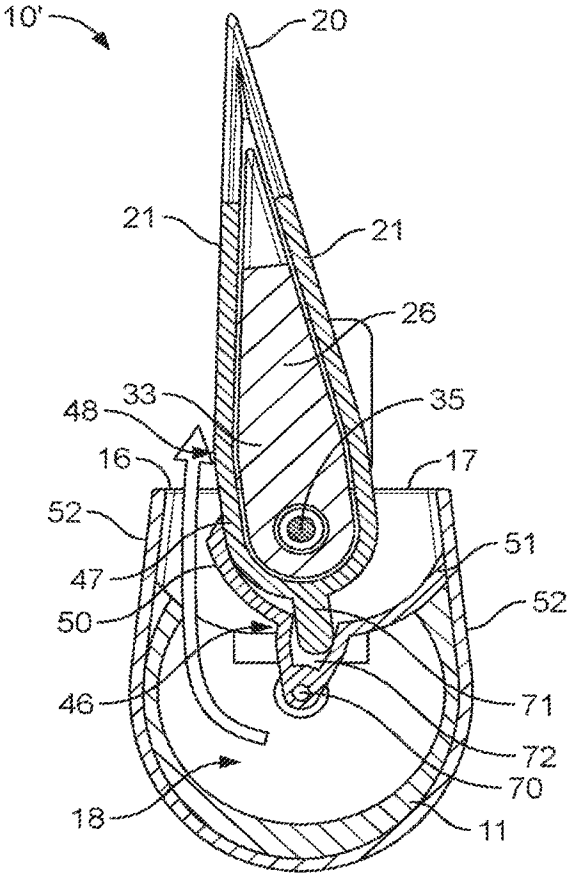

As is apparent from FIGS. 6A and 6B, like the first arrangement, the comb attachment 10' includes a flow director 46 for directing airflow to the first 16 or second 17 outlet. Unlike the first arrangement, the flow director 46 of the comb attachment 10' is separate to (i.e. is not integral with or mounted to) the first base portion 47. In particular, the flow director 46 is pivotally mounted to the housing 11 by way of a second pivot rod 70 (the first pivot rod 35 being that which mounts the second base portion 33 to the housing 11).

The flow director 46 is arranged so as to engage with the first base portion 47 in a region that is between the first 33 and second 70 pivot rods. To provide this engagement, the first base portion 47 includes a rearwardly projecting rib 71 that is received in a longitudinally extending groove 72 of the flow director 46. In operating, the flow director 46 moves in a rocking motion in response to movement of the rib 71 of the flow director 46. Thus, upon movement of the outer teeth 20 and inner protrusions 26 towards the first outlet 16 (i.e. towards the first position as per FIG. 6A), the rib 71 moves in the opposite direction (generally towards the second outlet 17) and engages the flow director 46 to pivot the flow director 46 such that a concave shaped second wing 51 of the flow director 46 obstructs flow to the second outlet 17. Likewise, movement of the outer teeth 20 and inner protrusions 26 to the second position (FIG. 6B) causes the flow director 46 to pivot such that a concave shaped first wing 50 of the flow director 46 obstructs flow to the first outlet 16.

Figure 7A:
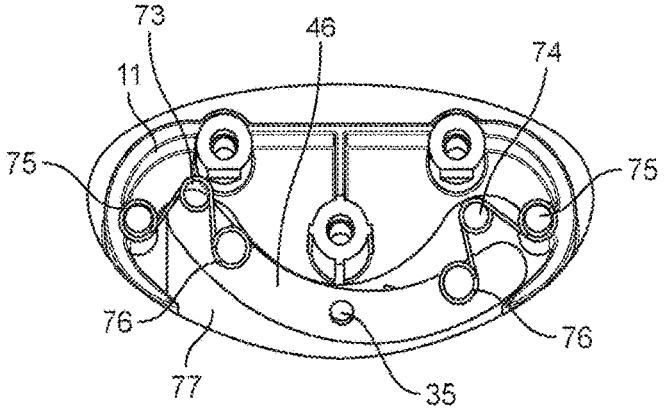
FIGS. 7A and 7B are examples of a latching arrangement in first and second positions.
Figure 7B:
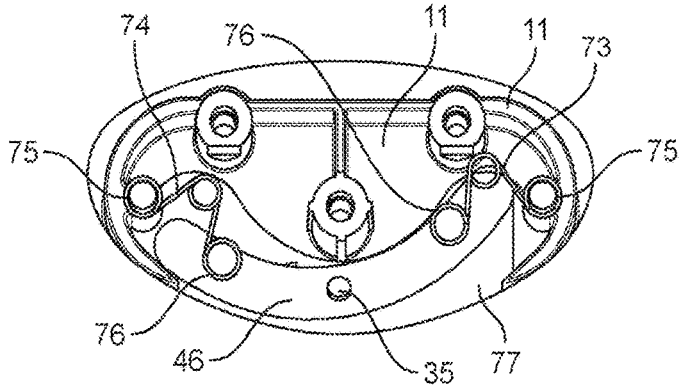

Although not illustrated, the presently described arrangement can include a latching arrangement, such as an arrangement of magnets like that described with respect to the first arrangement described above. However, either arrangement described above may include an alternative latching arrangement for maintaining the flow director 46 in the first or second position. One such alternative is shown in FIGS. 7A and 7B. This latching arrangement may be provided at one or both (longitudinal) ends of the flow director 46 or intermediate the ends. Rather than magnets, this alternative latching arrangement comprises first 73 and second 74 springs, which are in the form of a torsion springs. Each spring 73, 74 includes a first connector 75 rotatably connected to the housing 11, and a second connector 76 rotatably connected to the flow director 46.

The flow director 46 has a concave shape and is seated within a concave opening 77 within the housing 11. The arrangement of the springs 73, 74 is such that when the flow director 46 is in the first position (FIG. 7A) the springs 73, 74 urge the flow director in a clockwise direction, which retains the flow director 46 in the first position. Likewise, when the flow director 46 is in the second position (FIG. 7B), the springs 73, 74 urge the flow director in an anti-clockwise direction, which retains the flow director 46 in the second position. In the first and second positions, the springs 73, 74 are at their most relaxed. That is, movement out of the first and second positions causes the connectors 75, 76 of each spring 73, 74 to move towards one another, which results in compression of the spring 73, 74 (i.e. against the bias of the spring 73, 74). Accordingly, when the flow director 46 is between the first and second positions it is urged by the springs 73, 74 into the first or second position.

Figure 8:
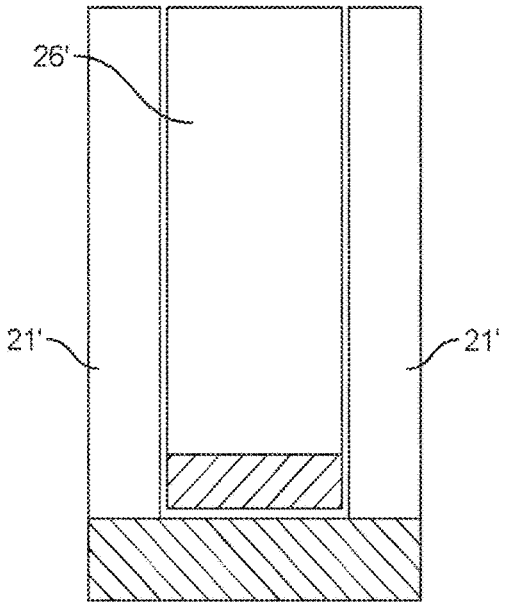
FIG. 8 is a schematic view depicting an example of an arrangement of inner and outer protrusions for a comb attachment.

In the above described arrangements, each outer protrusion 21 is joined to a corresponding outer protrusion 21 to form an outer tooth 20. In other arrangements, the two rows of outer protrusions 21 may remain separate from one another. FIG. 8 provides a schematic illustration of such an arrangement. In FIG. 8, each inner protrusion 26' has a generally rectangular shape, and two outer protrusions 21' extend either side of the inner protrusions 26' (along the long sides of the rectangular shape).

Figure 9A:
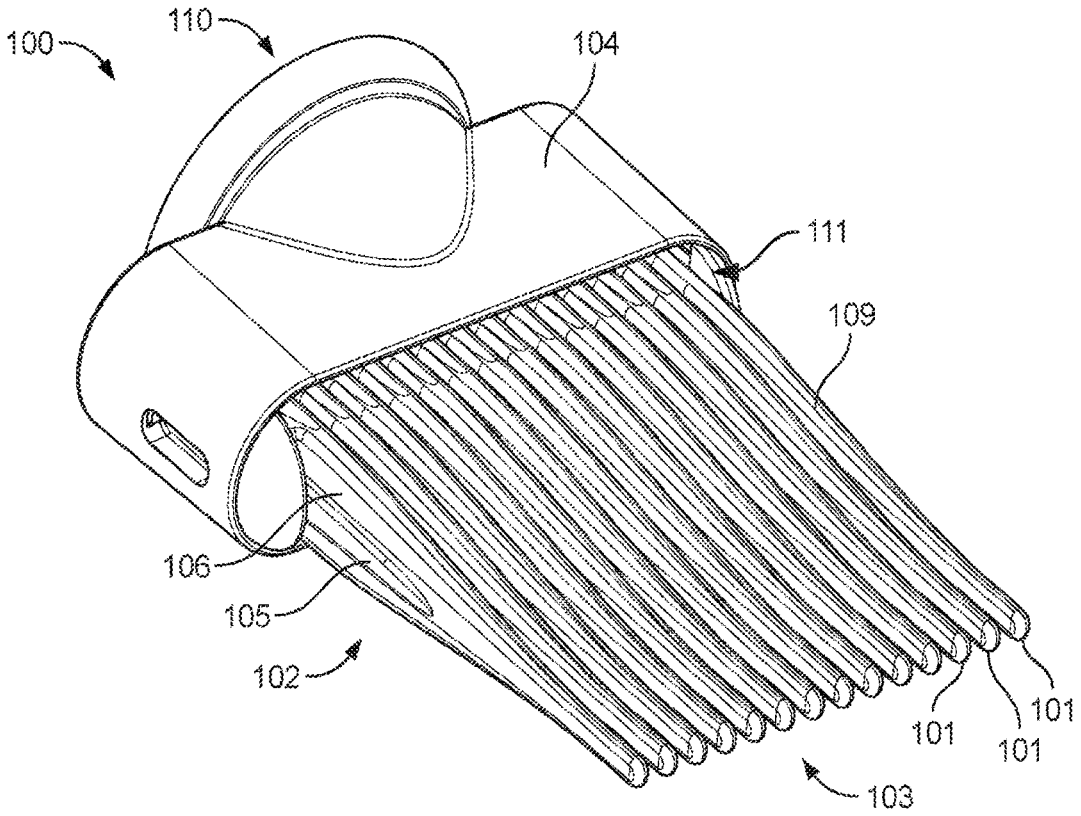
FIGS. 9A and 9B are respective perspective and front section views of a third comb attachment.
Figure 9B:
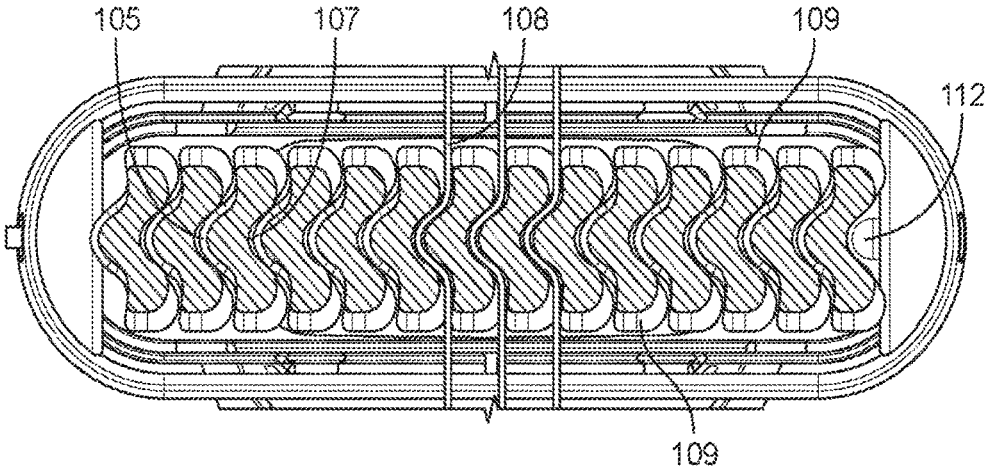

FIGS. 9A and 9B show a further comb attachment 100 that, like the previously described arrangements, can be used to provide variable tension to hair. However, the present comb attachment 100 differs from those previously disclosed in that it does not include inner and outer protrusions that move relative to one another to achieve the variable tension. Instead, and as will be described further below, the comb attachment 100 comprises a row of (substantially identical) teeth 101 spaced along a longitudinal axis that partly overlap with one another along the longitudinal axis to create a non-linear path for the passage of hair therethrough.

Each tooth 101 projects from a proximal end 102 that is proximate to a housing 104 (or support) from which the tooth projects, to a distal free end 103 that is distal from the housing 104. Each tooth 101 includes a protrusion 105 (one a first side thereof) that extends for substantially the length of the tooth 101 (from the proximal end 102 to the distal end 103), so as to be in the form of a ridge or rib. The protrusion 105 is more pronounced at the proximal end 102, and gradually decreases in height (from a body of the tooth 101) towards the distal end 103.

On a second side, opposite the first side, each tooth 101 also include a recess 107 that extends along the length of the tooth 101, so as to be in the form of a groove. Each recess 107 gradually reduces in depth from the proximal end 102 towards the distal end 103 of the tooth.

As is particularly apparent from FIG. 9B, the protrusion 105 of each tooth 101 is received in the recess 107 of a neighbouring tooth 101. Thus, each tooth 101 is partly nested within a neighbouring tooth (except, of course, for one of the two outermost teeth 101). One consequence of this nesting is that each pair of neighbouring (nested) teeth 101, where they are nested, define a non-linear transversely extending path 108 therebetween (as shown in FIG. 9B). Each non-linear path 108, in the presently described arrangement, is in a form comprising four generally 90 degree turns that form a bump-like shape in the path. The non-linear nature of the paths 108 mean that they provide more resistance to the passage of hair therealong than would otherwise be the case with a linear path. This resistance to the passage of hair allows tension to be applied to a tress of hair as the comb attachment 100 is passed along the tress of hair.

The tapered nature of the protrusions 105 and recesses 107 means that hair takes a different path between the neighbouring teeth 101 at distal ends 103 of the teeth 101. In particular, the transverse paths defined at the distal ends 103 (i.e. along which hair passes) are linear. Thus, each pair of neighbouring teeth 101 define a first path (at or near their proximal ends 102) that is more tortuous than a second path (at or near their distal ends 103). As should be appreciated, the tortuosity of the space between each pair of neighbouring teeth 101 (i.e. considered in the transverse direction) decreases gradually with distance from the proximal ends 102 of the teeth 101. Thus, the resistance to the passage of hair between neighbouring teeth 101 also decreases gradually with distance from the proximal ends 102 of the teeth 101.

Further contributing to this variation in resistance is the fact that the distance between neighbouring teeth 101 varies with distance from the proximal ends of the teeth 101. In particular, the spacing between neighbouring teeth 101 is smaller at their proximal ends 102 than at their distal ends 103, and this spacing varies gradually between the two ends 102, 103. The reduced spacing at the proximal ends 102 means there is greater resistance to the passage of hair at the proximal ends 102 than at the distal ends 103 of the teeth 101.

As is also evident from FIG. 9A, each tooth 101 is wider (i.e. in a direction that is transverse to the longitudinal axis along which the row of teeth 101 extends) at its proximal end 102 than its distal end 103. Thus, each tooth 101 has a greater surface area in contact with hair passing thereacross at its proximal end 102 than its distal end 103. This increases the amount of friction between the hair and each tooth 101 (at the proximal end 102) and, again, results in more resistance to the passage of hair towards the proximal ends of the teeth. Again, the width of each tooth 101 decreases gradually (i.e. tapers) from the proximal end 102 to the distal end 103. Thus, each tooth 101 includes opposed edges 109 (that lead and trial in use) that converge towards the distal end 103 of the tooth (i.e. that are sloped with respect to an elongate axis of each tooth 101). To reduce (or eliminate) damage to hair in use these edges 109 are rounded (i.e. radiused).

As noted above, the row of teeth 101 are mounted to a housing 104. The housing 104 includes an inlet 110 for receipt of an airflow from a hair care appliance, which in this case is a hair styler, that is configured to discharge an airflow. The housing 104 also includes an outlet 111 that is in fluid communication with the inlet 110 and that discharges airflow received from the inlet 110. The row of teeth 101 are supported on a support bar 112 that extends longitudinally across the outlet 111. Although not apparent from the figures, each tooth 101 is individually connected to the support bar 112. Such an arrangement means that, in practice, each tooth 101 flexes independently of the other teeth 101. This has been found to improve the comfort of the comb attachment 100 (i.e. because the teeth 101 are better able to accommodate different head shapes).

Figure 10A:
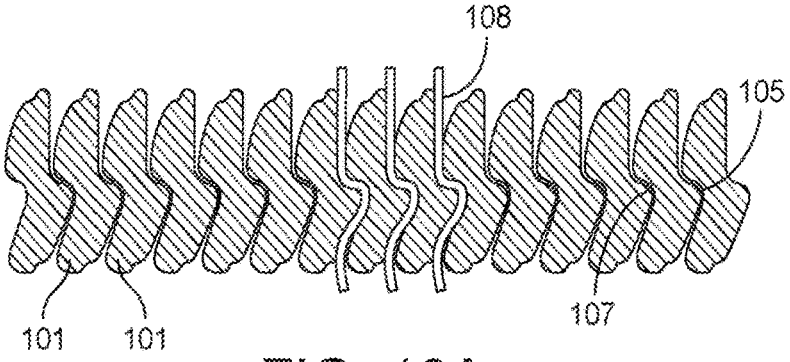
FIG. 10A is front section view of the teeth of a fourth comb attachment.
Figure 10B:
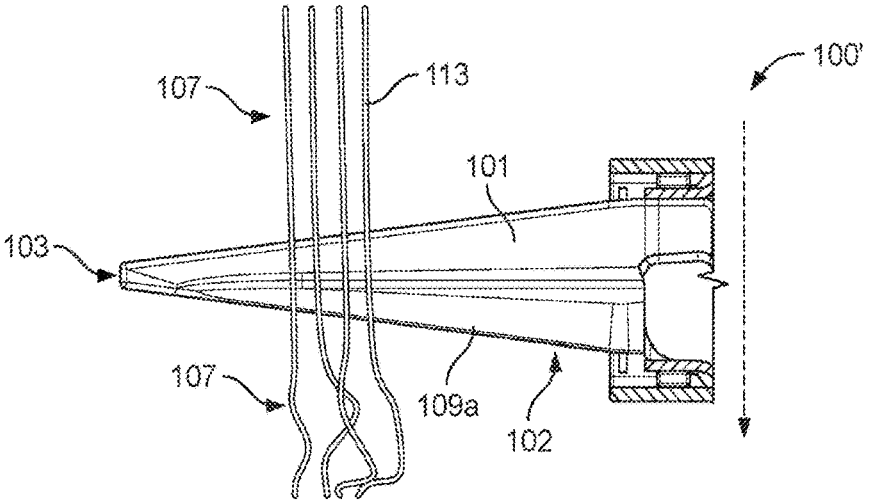
FIGS. 10B and 10C are top views of the fourth comb attachment in use.
Figure 10C:
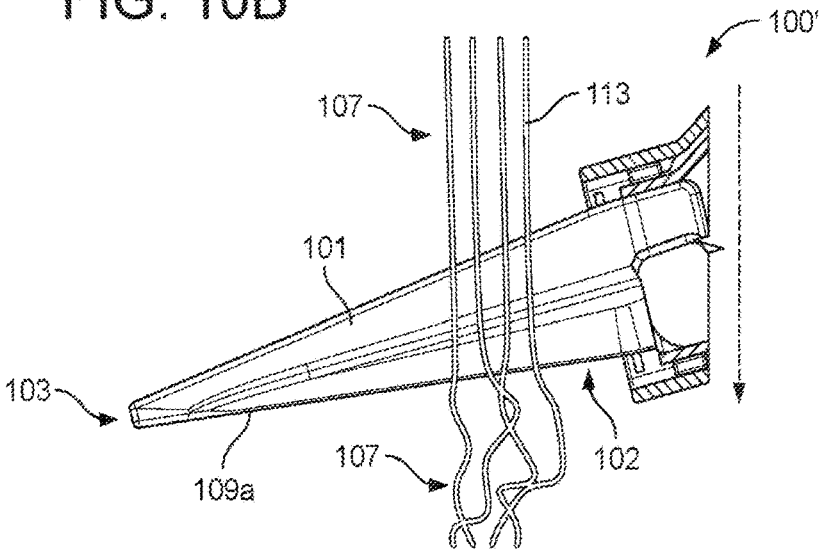

FIGS. 10A, 10B and 10C illustrate a variation of the comb attachment 100' that is of the same type as that shown in FIGS. 9A and 9B (and that is substantially the same as the previously described arrangement except for differences discussed below). FIGS. 10B and 10C, in particular, illustrate use of the comb attachment 100' (such use being equally applicable to the previously described comb attachment 100).

Each tooth 101 of the comb attachment 100', again, includes a protrusion 105 and a recess 107 on opposites sides of the tooth 101. However, these teeth each have an asymmetrical profile (i.e. taken transversely) such that the resulting transverse path 108 (along which hair extends in use) is asymmetrical (has an asymmetrical zig-zag shape). Accordingly, one side of the "bump" formed in each transverse path 108 (by nesting of the protrusion 105 in the recess 107) is steeper than the other. One practical result of this is that there is more resistance to the passage of hair along the path 108 (or, of course, the passage of the comb attachment 100 along a tress of hair) in one direction than in the opposite direction. This increases the versatility of the comb attachment 100' (i.e. increases the range of tensions that are able to be applied to a user's hair).

FIGS. 10B and 10C illustrate use of the comb attachment 100'. In FIG. 10B the comb attachment 100' is oriented such that a leading edge 109*a* of each tooth 101 is tilted (slightly) away from the direction of movement along the tress of hair 113 (as indicated by the dashed arrow). Due to this tilting, and friction between the hair 113 and the leading edges 109*a* causes the hair 113 to be urged in a direction towards the distal ends of the teeth 101. On the other hand, in FIG. 10C, the comb attachment 100' is oriented such that a leading edge 109*a* of each tooth 101 is tilted (slightly) away from the direction of movement of the comb attachment 100' along the tress of hair 113. Due to this tilting, and friction between the hair 113 and the leading edges 109*a*, the hair 113 is urged towards the proximal ends 102 of the teeth 101.

In this way, the hair is moved towards the proximal ends 102 or the distal ends 103 depending on the angle of the leading edges 109*a* of the teeth 101 with respect to the direction of movement of the comb attachment 100 (and with respect to an axis along which a tress of hair extends). As noted above, this action is a result of friction between the leading edges 109*a* of the teeth 101 and the hair. This is somewhat facilitated by the hair ahead of the leading edges 109*a* being somewhat curly/coily (which increases the friction at the leading edges 109*a*). That is, the attachment 100' may be particularly effective with type 3 or type 4 hair.

As has already been described (with respect to FIGS. 9A and 9B), the comb attachment 100' is configured such that the resistance to the passage of hair through the teeth 101 gradually increases from the proximal ends 102 of the teeth 101 to the distal ends of the teeth 101. Thus, by tilting the comb attachment 100 a user can adjust the resistance to the passage of hair through the teeth 101, so as to increase the tension applied to the tress of hair 113. Accordingly, the present arrangement (and that shown in FIGS. 9A and 9B) can provide varying tension without requiring any moving parts.

Figure 11A:
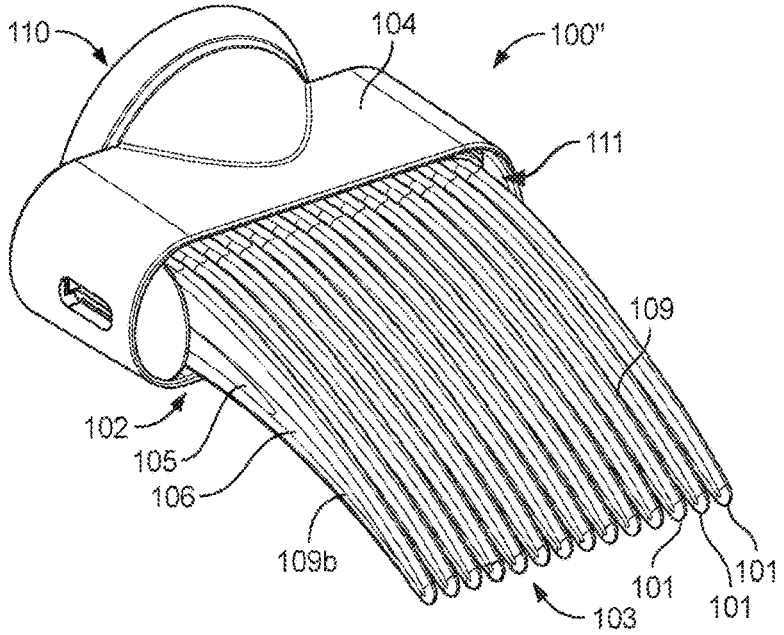
FIGS. 11A and 11B are respective perspective and front section views of a fifth comb attachment.
Figure 11B:
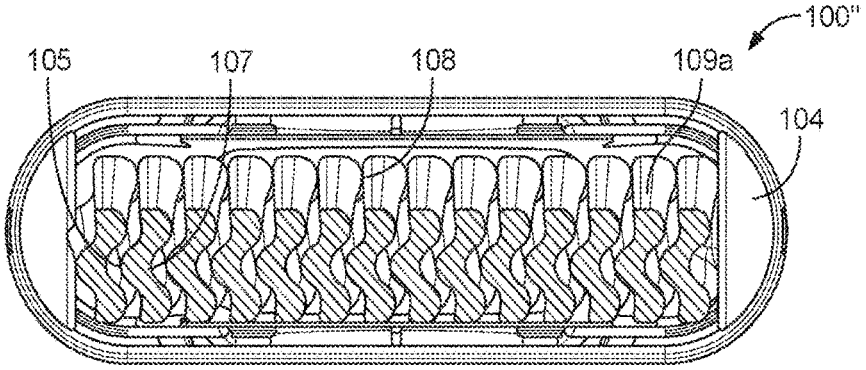

A further comb attachment 100" (which is a variation of those previously described) is shown in FIGS. 11A and 11B. This comb attachment 100" differs from that shown in FIGS. 9A and 9B only in that each tooth 101 is curved along its length (i.e. an elongate axis of each tooth 101 is curved). Accordingly, each tooth 101 includes a leading edge 109*a* (that leads along a tress of hair in normal use) that has a convex curvature, and an opposite trailing edge 109*b* (that trails along a tress of hair in normal use) that has a concave curvature.

The convex curvature of the leading edge 109*a* affects the manner in which hair is driven towards the distal 103 or proximal 102 ends of the teeth 101 when the tilted with respect to the direction of movement. As is apparent from FIG. 11C, the curvature means that, when the leading edge 109*a* is tilted towards the direction of movement (to move the hair towards the proximal ends 102), the angle of the leading edge 109*a* of each tooth 101 with respect to an axis (dashed line) that is perpendicular to the direction of movement increases in a direction towards the proximal ends 102 (i.e. the angle becomes steeper towards the proximal ends 102). The increase in angle towards the proximal ends 102 further urges the hair towards the proximal ends 102 so as to retain hair at or towards the proximal ends 102. This helps to retain the hair between the teeth 101. It has also been found that the curvature can provide a more gradual change in resistance as the comb attachment 100" is tilted.

Figure 11C:
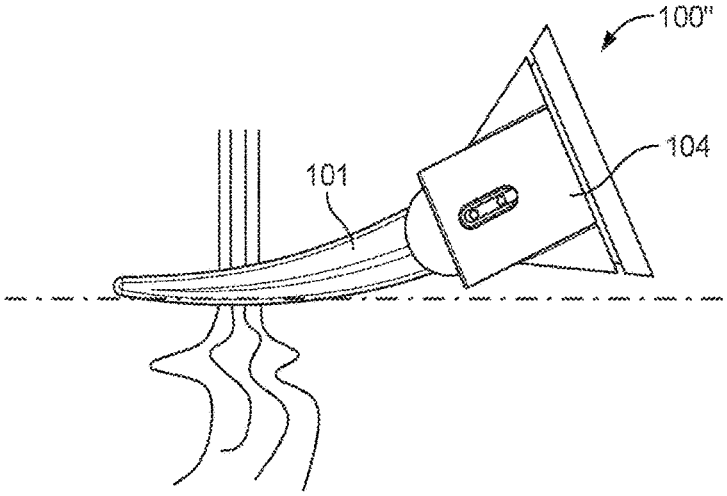
FIG. 11C is a top view of the fifth comb attachment in use.

The comb attachment 100" of FIG. 11A to 11C can also be used in the reverse direction (to that described above), with the concave edges 109*b* leading in movement. Such use of the comb attachment 100" may, for example, to provide root lift (i.e. to add volume to a user's hair).

Figure 12A:
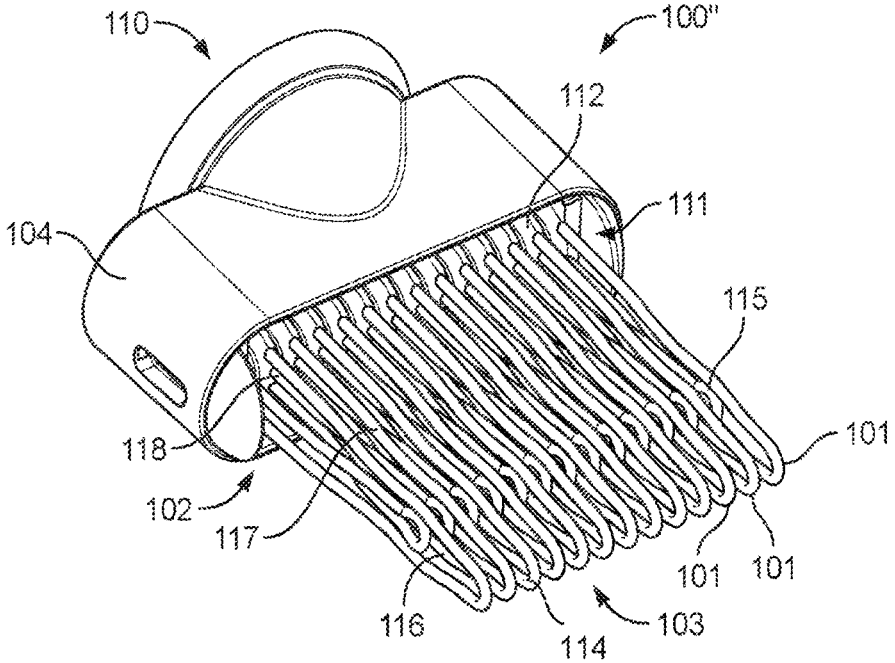
FIGS. 12A, 12B and 12C are respective perspective, side and bottom section views of a sixth comb attachment.
Figure 12B:
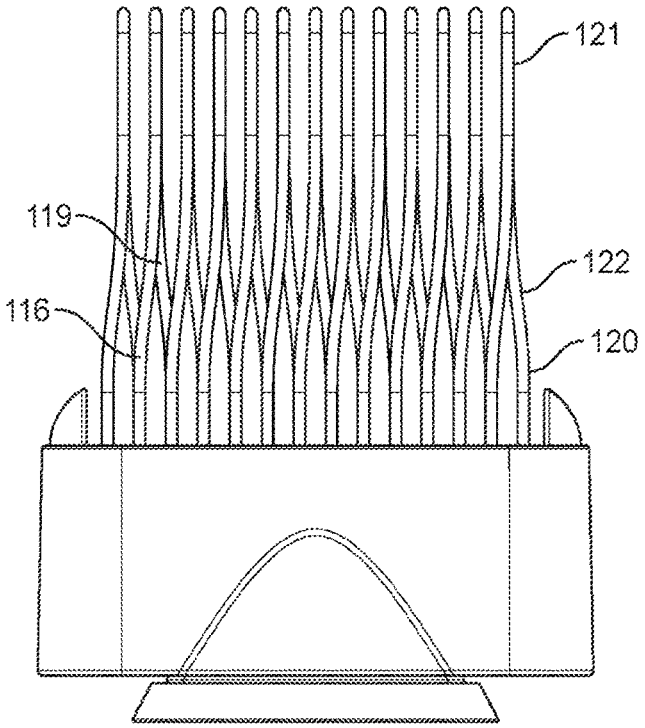
Figure 12C:
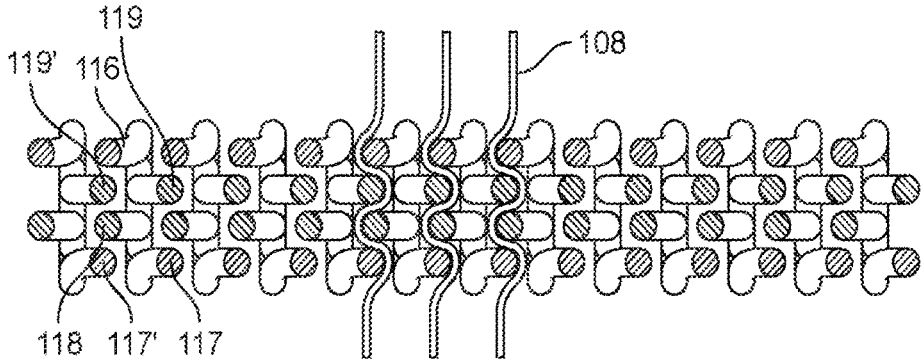

FIGS. 12A to 12C depict yet a further comb attachment 100''' of the type discussed above (i.e. with fixed teeth 101). In this arrangement, each tooth 101 includes an outer member 114 and an inner member 115 that is surrounded by the outer member 114. Both the inner 115 and outer 114 members are formed of steel wire. One benefit of this arrangement over those previously described is that there is more space for air from the outlet 111 to flow between the teeth 101. This can mean that more air is directed onto hair received between the teeth 101, which can improve the styling performance of the comb attachment 100'''. Further, when the airflow is heated, the steel rises in temperature and then transfers further heat to the hair (again improving the styling performance of the attachment 100''').

Each outer member 114 includes first 116 and second 117 legs that are joined at a distal end 103 of the respective tooth 101 (to form a generally V-shaped structure). Each inner member 115 includes third 118 and fourth 119 legs that are joined at a distal end. Each first leg 116 and third leg 118 extends in a first longitudinal direction (to the left in FIG. 12B), and each second leg 117 and fourth leg 119 extends in a second longitudinal direction that is opposite to the first direction. In particular, each leg 116, 117, 118, 119 includes a linear distal portion 121, a linear proximal portion 120, and a transition portion 122 that extends on a slope (in one of the first and second longitudinal directions) from the distal portion 121 to the proximal portion 120.

The result of this arrangement is that a proximal portion (i.e. towards the proximal end 102) of each first leg 116 (except for one of the two outermost first legs 116) is transversely aligned with the proximal portion of the second leg 117' of a neighbouring tooth 101 (neighbouring in the first direction). Likewise, the proximal portion of each third leg 118 (except for one of the two outermost third legs 118) is transversely aligned with the proximal portion of the fourth leg 119 of a neighbouring tooth 101 (neighbouring in the first direction). This is best seen in FIG. 12C (which is a section view looking towards the distal ends 102 of the teeth 101).

The interdigitated arrangement of the legs 116, 117, 118, 119 creates a tortuous (wavy) path 108 for hair that is received therebetween. As has already been discussed above, this creates resistance to the passage of hair between the teeth 101. The distal portions of the inner 115 and outer 114 members of each tooth 101 are aligned transversely (as is apparent from FIG. 12B), such that linear transverse paths (for the passage of hair) are defined between neighbouring teeth 101 at the distal ends 104 of the teeth 101. Accordingly, the resistance to the passage of hair increases with proximity to the proximal ends of the teeth 101.

Figure 13:
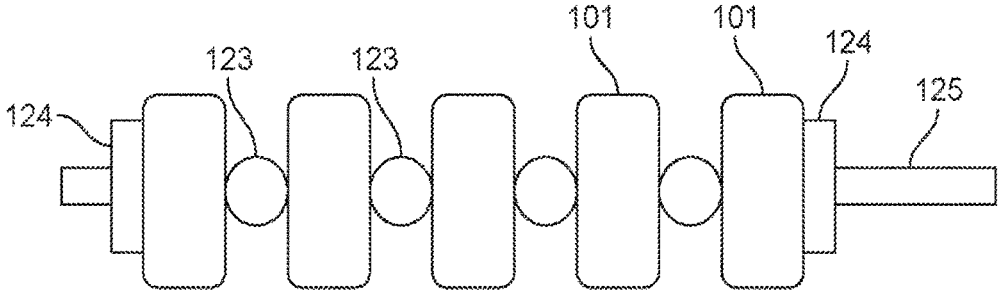
FIGS. 13 and 14 are schematic views depicting examples of means for adjusting the spacing between teeth of a comb attachment.
Figure 14:
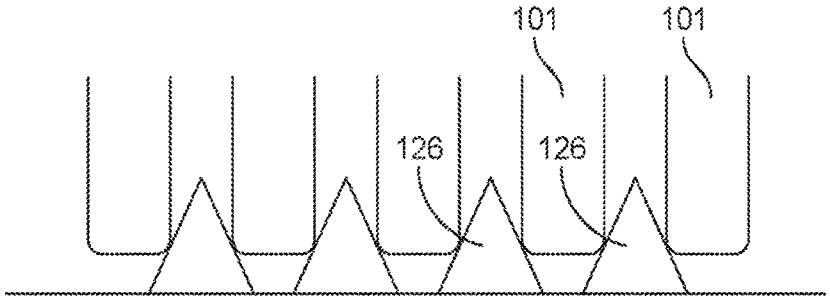

In each of the arrangements described above (from FIGS. 9A to 12C), the distance between the teeth 101 is fixed. In other arrangements the spacing between the teeth 101 may be adjustable (to adjust the tension provided by the comb attachment). FIGS. 13 and 14 illustrate two examples of how such adjustment may be provided.

In the arrangement shown in FIG. 13, biasing elements 123 are provided between the proximal ends of neighbouring teeth 101. The biasing elements 123 are configured to urge the neighbouring teeth 101 away from one another. Also provided is a clamping arrangement having two opposed clamping members 124 provided on a threaded rod 125. One of the clamping members 124 can be rotated to move the clamping member 124 along the rod 125 toward the other clamping member 124 (against the bias of the biasing elements 123), to reduce the spacing between the teeth 101.

In the arrangement shown in FIG. 14, wedge elements 126 are provided between the proximal ends of neighbouring teeth 101. The wedge elements 126 can be moved in a direction towards or away from the teeth 101 to increase or decrease the spacing between the teeth 101.

Figure 15A:
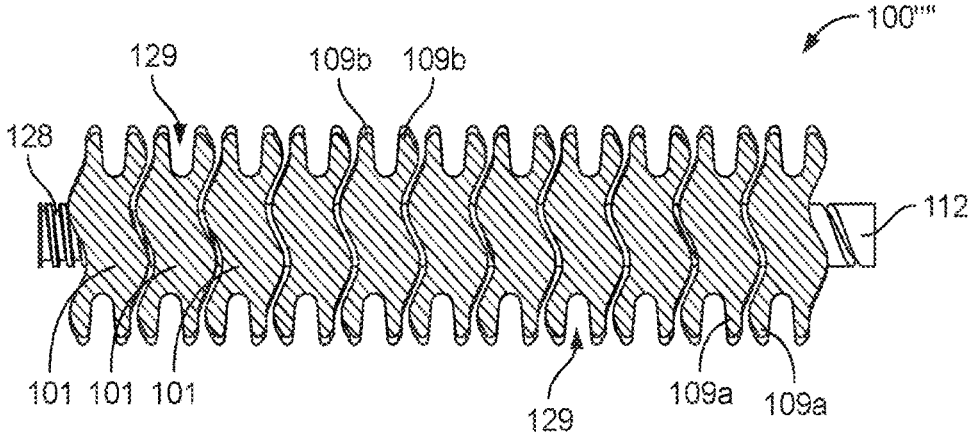
FIGS. 15A and 15B are respective section and side views of a sixth comb attachment.
Figure 15B:
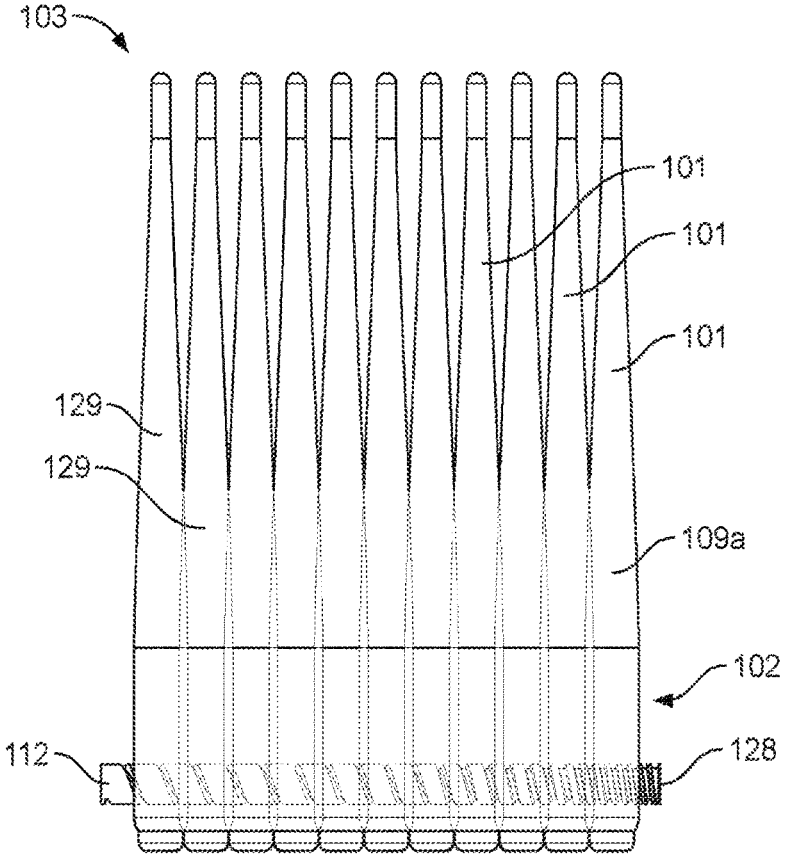
Figure 16:
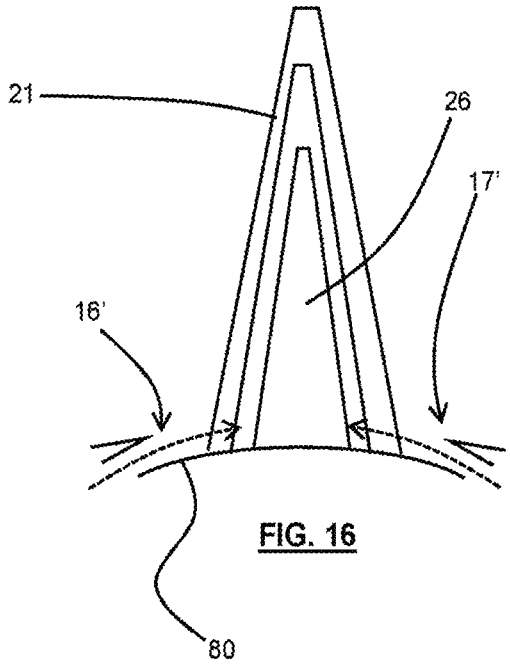
FIG. 16 is a top section view showing an alternative inner/outer protrusion arrangement to that of FIGS. 4A and 4B.

FIGS. 15A and 15B depict a comb attachment 100" " that includes a further means for altering the spacing between the teeth 101. In particular, the attachment 100"" includes a threaded support bar 112 from which the teeth 101 extend. The thread 128 of the support bar 112 has a pitch that varies along the length of the support bar 112. Thus, at one end of the support bar 112 adjacent loops of the thread 128 are closer together than at the other end of the support bar 112 (and this varies gradually from one end to the other).

Although not apparent from the figures, each tooth 101 includes an aperture (at its proximal end 102) through which the threaded support bar 112 extends. Each tooth 101 also includes an engagement member (also not shown) extending into the aperture that engages the thread 128 of the support bar 112 such that movement of the thread 128 causes movement of each tooth 101. In particular, rotation of the support bar 112 (and thus rotation of the thread 128) results in movement of the teeth 101 in an axial direction of the support bar 112 (i.e. along the length of the support bar 112).

As may be appreciated, each tooth 101 moves at a different rate to the other teeth 101, depending on the pitch of the thread 128 at the point at which the tooth 101 engages the thread 128. Thus, teeth 101 at an end of the support bar 112 where the thread 128 has a greater pitch move a greater distance than teeth at an end of the support bar 112 where the thread 128 has a smaller pitch (i.e. in response to a rotation of the support bar 112). The result of such an arrangement is that the teeth 101 remain equi-spaced as they move along the support bar 112 (with the spacing increasing/decreasing with such movement).

A further feature of the attachment 100"" of FIGS. 15A and 15B, which is not present in the previously described embodiments is lateral grooves 129 that are formed in each tooth 101. In particular (and as is most apparent from FIG. 15A), each tooth 101 includes two grooves 129 extending along (for part of the length of) opposed leading 109*a* and trailing 109*b* edges of the tooth 101.

In operation, air discharged by a hair care appliance (to which the attachment 100"" is mounted) is able to pass along the grooves 129. The presence of the grooves 129 means that the teeth 101 present less of an obstruction to airflow (than would otherwise be the case in the absence of the grooves 129). Likewise, when the airflow is a heated airflow, air flowing through the grooves 129 is able to heat the teeth 101. This heat is transferred from the teeth 101 to a user's hair, which can improve the styling performance of the attachment 100"".

Figure 18:
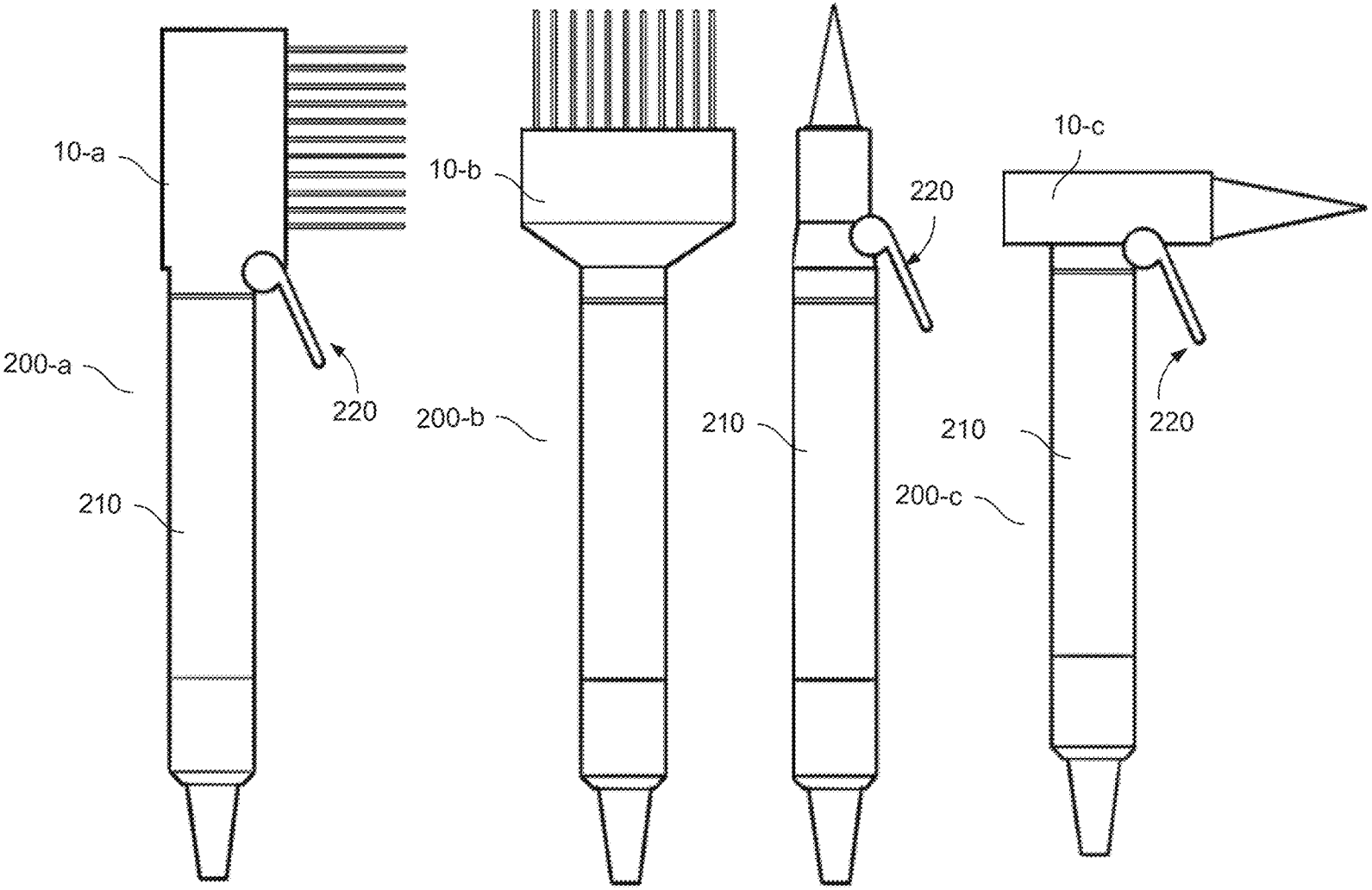
FIG. 18 is a schematic view of an attachment according to the invention attached to an appliance in various orientations.

FIG. 18 shows an attachment attached to a hair care appliance in different orientations to provide different functionality and useability. The haircare appliance 200-*a,b,c* comprise a handle unit 210, and an attachment 10,-*a,b,c*, removably attachable to the handle unit 210. Attachments 10-*a,b,c* are according to the invention described herein, and are illustrated here to highlight various orientations of attachments relative to the handle unit 210 of the haircare appliance the attachment 10,-*a,b,c,d* is being used with. The handle unit 210 is cylindrical and extends by a length in a direction perpendicular to its circular cross-section.

Attachment 10-*a* is orientated such that each protrusion of the attachment 10-*a* extends perpendicular to the length of the handle unit 210. The axis of the row of protrusions—that is, the axis from which the protrusions emanate—is aligned parallel to the length of the handle unit 210.

Attachment 10-*b* is shown in two orientations and is aligned such that each protrusion of the attachment 10-*b* extends parallel to the length of the handle unit 210, and the axis of the row of protrusions is aligned perpendicular to the length of the handle unit 210.

Attachment 10-*c* is aligned such that each protrusion of the attachment 10-*c* extends perpendicular to the length of the handle unit 210, and the axis of the row of protrusions is aligned perpendicular to the length of the handle unit 210.

Each attachment 10-*a,b,c* is shown with an adjustable trigger 220 to enable variable tensioning adjusted by a user, such a trigger is not essential to some of the embodiments described herein.

The exemplary embodiments set forth above are considered to be illustrative and not limiting. Various changes to the described arrangements may be made without departing from the spirit and scope of the invention.

As an example, the flow director feature of FIGS. 4A, 4B, 6A and 6B could be applied to the fixed tooth arrangements of FIGS. 9A to 12C. That is, the fixed tooth arrangements could include two spaced apart outlets and a flow director for directing airflow to one of the outlets (in response to movement of the teeth).

For the avoidance of any doubt, any theoretical explanations provided herein are provided for the purposes of improving the understanding of a reader. The inventors do not wish to be bound by any of these theoretical explanations.

Any section headings used herein are for organizational purposes only and are not to be construed as limiting the subject matter described.

Throughout this specification, including the claims which follow, unless the context requires otherwise, the word "comprise" and "include", and variations such as "comprises", "comprising", and "including" will be understood to imply the inclusion of a stated integer or step or group of integers or steps but not the exclusion of any other integer or step or group of integers or steps.

It must be noted that, as used in the specification and the appended claims, the singular forms "a," "an," and "the" include plural referents unless the context clearly dictates otherwise. Ranges may be expressed herein as from "about" one particular value, and/or to "about" another particular value. When such a range is expressed, another embodiment includes from the one particular value and/or to the other particular value. Similarly, when values are expressed as approximations, by the use of the antecedent "about," it will be understood that the particular value forms another embodiment. The term "about" in relation to a numerical value is optional and means for example +/−10%.

The invention claimed is:

1. A comb for mounting to a hair-care appliance configured to supply a heated airflow, the comb comprising:

a housing defining an inlet for receiving an airflow from the appliance when mounted thereto and an outlet fluidly connected to the inlet for discharging the airflow;

first and second tooth structures mounted to the housing, each tooth structure comprising a row of teeth extending longitudinally across the outlet, the first tooth structure being moveable longitudinally relative to the second tooth structure; and a trigger operatively connected to the first or second tooth structure and configured such that depressing the trigger provides relative longitudinal movement between the teeth of the first tooth structure and the teeth of the second tooth structure from a retracted position for receiving a tress of hair between teeth of the first and second tooth structures to an extended position for clamping the tress of hair between teeth of the tooth structures, wherein the trigger is pivotally mounted to the housing so as to pivot about a first pivot axis.

2. The comb according to claim 1, further comprising a biasing member mounted to at least one of the first and second tooth structures, the biasing member configured to urge the first and second tooth structures towards the retracted position.

3. The comb according to claim 1, wherein:

in the retracted position, each tooth of the first tooth structure is longitudinally spaced from a corresponding tooth of the second tooth structure so as to define a hair-receiving space therebetween for receipt of a tress of hair; and in the extended position, each tooth of the first tooth structure is displaced from its retracted position in a direction towards the respective corresponding tooth of the second tooth structure to clamp the tress of hair.

4. The comb according to claim 1, wherein in the retracted position, each tooth of the first tooth structure is transversely aligned with a tooth of the second tooth structure.

5. The comb according to claim 1, wherein the first tooth structure comprises a first surface that opposes and is longitudinally spaced from a second surface of the second tooth structure, and wherein a biasing arrangement comprises a biasing member extending between the first and second surfaces.

6. A comb comprising:

a housing;

first and second tooth structures mounted to the housing, each tooth structure comprising a longitudinally extending row of teeth, the first tooth structure being moveable longitudinally relative to the second tooth structure;

a trigger operatively connected to the first or second tooth structures and configured such that depressing the trigger moves the teeth of the first tooth structure longitudinally relative to the teeth of the second tooth structure from a retracted position for receiving a tress of hair between teeth of the first and second tooth structures to an extended position for clamping the tress of hair between teeth of the tooth structures; and a biasing member connected between the first and second tooth structures and configured to urge the first and second tooth structures towards the retracted position, wherein the trigger is pivotally mounted to the housing so as to pivot about a first pivot axis.

7. The comb according to claim 6, wherein:

in the retracted position, each tooth of the first tooth structure is longitudinally spaced from a corresponding tooth of the second tooth structure so as to define a hair-receiving space therebetween for receipt of a tress of hair; and in the extended position, each tooth of the first tooth structure is displaced from its retracted position in a direction towards the respective corresponding tooth of the second tooth structure to clamp the tress of hair.

8. The comb according to claim 6, wherein in the retracted position, each tooth of the first tooth structure is transversely aligned with a tooth of the second tooth structure.

9. The comb according to claim 6, wherein the first tooth structure comprises a first surface that opposes and is longitudinally spaced from a second surface of the second tooth structure, and wherein a biasing arrangement comprises the biasing member extending between the first and second surfaces.

10. The comb according to claim 9, wherein the biasing member is configured to urge the first and second surfaces apart.

11. The comb according to claim 10, wherein the biasing member is a compression spring.

12. The comb according to claim 6, wherein the trigger comprises a lever portion at a first end thereof, and an engagement portion at an opposite second end thereof.

13. The comb according to claim 12, wherein the trigger is arranged such that, when depressed, the engagement portion engages one of the first and second tooth structures to move the first or second tooth structure between the retracted and extended positions.

14. The comb according to claim 12, comprising an intermediate member operatively connected between the trigger and one of the first and second tooth structures.

15. The comb according to claim 14, wherein the intermediate member is pivotally mounted to the housing so as to pivot about a second pivot axis, the intermediate member comprising an engagement portion that engages one of the first and second tooth structures, and a cam surface disposed between the second pivot axis and the engagement portion, the engagement portion of the trigger being arranged to engage the cam surface when depressed to cause the intermediate member to pivot.

16. The comb according to claim 12, wherein the lever portion of the trigger extends at a first angle to the longitudinal axis in the retracted position, and at a second angle to the longitudinal axis in the extended position, and wherein the second angle is smaller than the first angle.

17. The comb according to claim 6, wherein the trigger projects from the same side of the comb as the teeth of the first and second tooth structures.

18. The comb according to claim 4, wherein the trigger projects in a plane that is parallel to planes in which the teeth of the first and second tooth structures extend.

19. The comb according to claim 6, wherein the teeth of the first tooth structure represent a first row of outer protrusions, the teeth of the second tooth structure represent a row of inner protrusions, and the comb further comprises a second row of outer protrusions, the row of inner protrusions interposed between the first and second rows of outer protrusions, and wherein each outer protrusion of the first row is transversely spaced from a corresponding outer protrusion of the second row so as to define an outer protrusion pair.

* * * * *